US011123849B2

(12) United States Patent
Ishikawa et al.

(10) Patent No.: US 11,123,849 B2
(45) Date of Patent: Sep. 21, 2021

(54) DRIVING TOOL

(71) Applicant: MAKITA CORPORATION, Anjo (JP)

(72) Inventors: Naoharu Ishikawa, Anjo (JP); Noriyuki Nishido, Anjo (JP)

(73) Assignee: MAKITA CORPORATION, Anjo (JP)

( * ) Notice: Subject to any disclaimer, the term of this patent is extended or adjusted under 35 U.S.C. 154(b) by 152 days.

(21) Appl. No.: 16/489,375

(22) PCT Filed: Feb. 23, 2018

(86) PCT No.: PCT/JP2018/006778

§ 371 (c)(1),
(2) Date: Aug. 28, 2019

(87) PCT Pub. No.: WO2018/159500

PCT Pub. Date: Sep. 7, 2018

(65) Prior Publication Data

US 2019/0375083 A1 Dec. 12, 2019

(30) Foreign Application Priority Data

Mar. 1, 2017 (JP) ..... JP2017-038480

(51) Int. Cl.
*B25C 1/04* (2006.01)
*B25C 1/06* (2006.01)
*B25C 7/00* (2006.01)

(52) U.S. Cl.
CPC ..... *B25C 1/043* (2013.01); *B25C 1/06* (2013.01); *B25C 7/00* (2013.01)

(58) Field of Classification Search
CPC ..... B25C 1/043; B25C 1/06; B25C 7/00
See application file for complete search history.

(56) References Cited

U.S. PATENT DOCUMENTS 5,732,870 A 3/1998 Moorman et al.
5,772,096 A * 6/1998 Osuka ..... B25C 1/008 227/130
5,918,788 A 7/1999 Moorman et al.
(Continued)

FOREIGN PATENT DOCUMENTS

JP H08-276375 A 10/1996
JP H09-507172 A 7/1997
(Continued)

OTHER PUBLICATIONS

Nov. 4, 2020 Office Action issued in Japanese Patent Application No. 2017-038480.
(Continued)

*Primary Examiner* — Nathaniel C Chukwurah
*Assistant Examiner* — Lucas E. A. Palmer
(74) *Attorney, Agent, or Firm* — Oliff PLC

(57) ABSTRACT

In driving tools that perform driving actions on the condition that both the trigger and contact arm are activated, when the reference time t is reached after the trigger is activated, the power supply to the actuator is cut off, thereby allowing the contact arm stopper element to be moved to the lock position. The lock arm prohibits activation of the contact arm. The quicker motion of the actuator achieves a smoother transition to the locked state.

23 Claims, 16 Drawing Sheets

(56) References Cited

U.S. PATENT DOCUMENTS

| | | | | |
|---|---|---|---|---|
| 6,382,492 | B1 | 5/2002 | Moorman et al. | |
| 6,431,425 | B1 | 8/2002 | Moorman et al. | |
| 2008/0017689 | A1* | 1/2008 | Simonelli | B25C 1/008 227/132 |
| 2014/0110450 | A1* | 4/2014 | Moore | B25C 1/008 227/2 |
| 2014/0110452 | A1* | 4/2014 | Moore | B25C 1/008 227/8 |
| 2014/0231485 | A1 | 8/2014 | Bauer | |
| 2018/0117748 | A1 | 5/2018 | Ishikawa et al. | |

FOREIGN PATENT DOCUMENTS

| | | | |
|---|---|---|---|
| WO | 2007/142997 | A2 | 12/2007 |
| WO | 2016/152862 | A1 | 9/2016 |

OTHER PUBLICATIONS

Apr. 17, 2018 International Search Report issued in International Patent Application No. PCT/JP2018/006778.
Apr. 17, 2018 Written Opinion issued in International Patent Application No. PCT/JP2018/006778.

* cited by examiner

DRIVING TOOL

CROSS-REFERENCE TO RELATED APPLICATIONS

The present application is a U.S. National Phase entry of, and claims priority to, PCT Application No. PCT/JP2018/006778, filed Feb. 23, 2018, which claims priority to Japanese Patent Application No. 2017-038480, filed Mar. 1, 2017, both of which are incorporated herein by reference in their entireties for all purposes.

TECHNICAL FIELD

The present disclosure relates to a driving tool, such as a nail gun.

BACKGROUND ART

For example, in a compressed-air powered nail gun, the tool body is operated on the condition that both the contact arm on the end of the nose element is pressed against the target workpiece so that the contact arm is moved upward relative to an injection port (i.e. the contact arm activation) and the condition that the trigger is pulled with a finger (i.e. the trigger activation). No driving action is performed when only one of them is activated, which avoids inadvertently caused driving actions.

This type of driving tool allows different methods of causing driving actions, including the aiming method in which the contact arm is activated first by being pressed against the target workpiece and then the trigger is pulled, the dragging method in which the trigger is activated while the driving tool is slid with the contact arm kept activated, and the shaking method in which the driving tool is bounced upward/downward to activate/deactivate the contact arm while the trigger is continuously being pulled. In the aiming and dragging methods, a subsequent driving action after the first is not performed unless the trigger is deactivated (referred to as the single-driving methods). In contrast, using the shaking method, continuous driving actions can be performed by repeatedly activating/deactivating the contact arm once the trigger is pulled (referred to as the continuous-driving method).

Patent Document 1 (U.S. Pat. No. 5,732,870) discloses an electronically controlled solenoid valve being used to operate the head valve that switches supply and shutoff of compressed air to the driving unit. Patent Documents 2 (US Patent Publication No. 2014/0110450) and 3 (US Patent Publication No. 2014/0110452) disclose a driving tool that uses an electronically controlled solenoid valve to switch between continuous- and single-driving methods. The electronically controlled solenoid valve (as the starting valve) appropriately controls driving actions in the single- and continuous-driving methods. However, in Patent Documents 1 to 3, compressed air is used as part of the power source for moving the stem of the starting valve. Accordingly, it takes time to activate/deactivate the starting valve, resulting in the problem of a decrease in the quick-firing performance of the driving action.

Patent Document 4 (Japanese Patent No. 3287172) discloses switching modes by micro switches detecting activation of the contact arm and activation of the trigger separately. A timer measures the time elapsed after the activation of the contact arm. In the mode switching disclosed in Patent Document 4, in the single-driving mode, a driving action is performed by activating the trigger within a fixed time after activation of the contact arm.

The prohibition state of subsequent driving actions after the first driving action is removed by deactivation of the trigger. In the continuous-driving mode, the timer resets and driving actions can be repeated, provided that each activation of the contact arm occurs while the trigger is continuously activated and within the fixed time between each activation of the contact arm. However, if the contact arm is not activated within the fixed time, any subsequent activations of the contact arm are essentially invalidated, so that these drive operations are electronically prohibited. Alternatively, a lock pin is engaged with the contact arm to lock the contact arm in the deactivated position so that drive operations are prohibited. This mode switching avoids inadvertent driving actions caused in the continuous driving mode by an accidental contact of the contact arm with some other object when, for example, the tool is carried by the grip with the trigger kept activated.

SUMMARY OF THE INVENTION

In Patent Document 4 described above, the use of a manually operated starting valve avoids the problem of a decrease in quick-firing performance caused by using electronically operated starting valves. However, in Patent Document 4, when the battery charge drops to a low level and the power supply to the controller, which operates in response to input signals, is lost or shut off, the controller can no longer allow driving actions, resulting in the problem that work has to be suspended. This is also the case in Patent Documents 1 to 3. That is when the power supply is stopped in Patent Documents 1 to 3, the starting valve, which is electronically operated, is unable to operate, and therefore cannot cause driving actions.

The present disclosure has been made to solve the above-mentioned problems present in conventional tools, and aims to allow continuation of the driving work when the battery (or power supply) for the electrically-powered controls is insufficient.

The problem posed above is solved by the following disclosure. A first embodiment is a driving tool comprising a tool body, a trigger, and a contact arm, the tool body operating on condition that both the trigger and the contact arm are activated. The driving tool of the first embodiment further comprises a timer mechanism starting when the trigger is activated while the contact arm is not activated. The timer mechanism in the first embodiment comprises a timer switch, wherein the time switch is released by activation of the trigger, and comprises a contact arm stopper element for preventing activation of the contact arm. When a released time of the timer switch reaches a preset reference time, the contact arm stopper element is moved to a lock position to prevent activation of the contact arm.

In the first embodiment, if the trigger is activated first, the timer is controlled to prevent activation of the contact arm after the reference time has been reached, thereby prohibiting driving actions. This timer control reliably prevents, after the reference time has been reached, an inadvertent driving action from being caused in the tool main body by an accidental contact of the contact arm with some other object when. For example, there is no driving action if the driving tool is carried while the trigger is being activated.

In the first embodiment, the reference time is set for the movement of the contact arm stopper element from the unlock position to the lock position, so that the time duration of the movement of the contact arm stopper element from the unlock position to the lock position corresponds to the reference time. The reference time measurement starts from the time when the timer switch is turned on by activation of the trigger. The reference time is set and measured by a control unit that controls operation of the contact arm stopper element. When moved to the lock position, the contact arm stopper element interferes the contact arm and thus physically prevents activation of the contact arm. The timer mechanism of the first embodiment operates when the trigger is activated first, and not when the contact arm is activated first. This allows driving actions to be caused by activating the contact arm first and the driving work to be continued, even under conditions where the power required for the operation of the timer switch is insufficient to operate the timer mechanism.

A second embodiment is the driving tool of the first embodiment, wherein the timer switch is turned on by activation of the trigger and turned off by activation of the contact arm.

In the second embodiment, when the contact arm is activated before the reference time is reached after the trigger has been activated, the operation of the timer mechanism is canceled (e.g., reset to the initial state) and a driving action is performed.

A third embodiment is the driving tool of the second embodiment, wherein the timer switch is released by deactivation of the contact arm.

In the third embodiment, when the contact arm is deactivated after a driving action, the timer switch is released and measurement of the reference time is started. The operation of the timer mechanism is canceled by additionally deactivating the trigger to reset the timer mechanism to the initial state.

A fourth embodiment is the driving tool of any one of the first to third embodiments, further comprising an actuator, wherein when the reference time has been reached, the actuator allows the contact arm stopper element to be moved to the lock position.

In the fourth embodiment, when the reference time has been reached, the actuator operates and the contact arm stopper element is allowed to move toward the lock position.

A fifth embodiment of any one of the first to fourth embodiments includes that when the trigger is deactivated, the timer switch is turned off and the contact arm stopper element is returned to an unlock position.

In the fifth embodiment, when the trigger is deactivated, the timer mechanism is reset to the initial state and the contact arm is allowed to be activated (e.g., the driving tool is returned to the initial state).

In the sixth embodiment of any one of the first to fifth embodiments, when the contact arm is activated earlier than the trigger being activated, the contact arm stopper element is prevented from moving toward the lock position.

In the sixth embodiment, when the contact arm is activated earlier than the trigger, the operation of the timer mechanism is prevented or stopped.

A seventh embodiment is a driving tool comprising a tool body, a trigger, and a contact arm, the tool body operating on condition that both the trigger and the contact arm are activated. The driving tool of the seventh embodiment further comprises a timer mechanism started when the trigger is activated while the contact arm is not activated. In the seventh embodiment, the timer mechanism comprises a trigger switch wherein the trigger switch is turned on by activation of the trigger, a contact arm switch wherein the contact arm switch is turned on by activation of the contact arm, and a contact arm stopper element for preventing activation of the contact arm. When a time during which the trigger switch allows current to flow and in which the contact arm switch allows current to flow reaches a preset reference time, the contact arm stopper element is moved to a lock position to prevent activation of the contact arm.

In the seventh embodiment, the trigger switch and the contact arm switch detect activations of the trigger and the contact arm, respectively, and then the reference time is measured. In the seventh embodiment, activation of the contact arm is prevented when the reference time has been reached. Accordingly, after the passage of reference time, an inadvertent driving action is reliably prevented from being caused in the tool main body. For example, the driving operation may be prevented from being caused by an accidental contact of the contact arm with some other object when, for example, the driving tool is carried while the trigger is being activated. The timer mechanism of the seventh embodiment operates when the trigger is activated first, and not when the contact arm is activated first. Therefore, the driving action can be performed by activating the contact arm first. Thus, the driving work can be continued even in a condition where the power required for the operation of the trigger switch and contact arm switch is insufficient to operate the timer mechanism.

An eighth embodiment is the driving tool of any one of the first to seventh embodiments, including that when the contact arm is activated, a driving action is performed by activation of the trigger, regardless of the timer mechanism.

In the eighth embodiment, it is possible, even when there is no power supply, to use what is called the aiming method (or other single-driving method) of causing driving actions, i.e. by pressing the contact arm against the target workpiece and then activating the trigger. This leads to higher work efficiency with the driving tool.

BRIEF DESCRIPTION OF THE DRAWINGS

FIG. 13 is a longitudinal cross-sectional view of the starting device of the first embodiment in the state where the contact arm has been activated after the trigger was activated and within the reference time, and where the starting valve has been turned on.

FIG. 14 is a longitudinal cross-sectional view of the starting device of the first embodiment in the state where the contact arm has been activated after the trigger was activated and within the reference time, and where the starting valve has been turned on.

DETAILED DESCRIPTION

Figure 1:
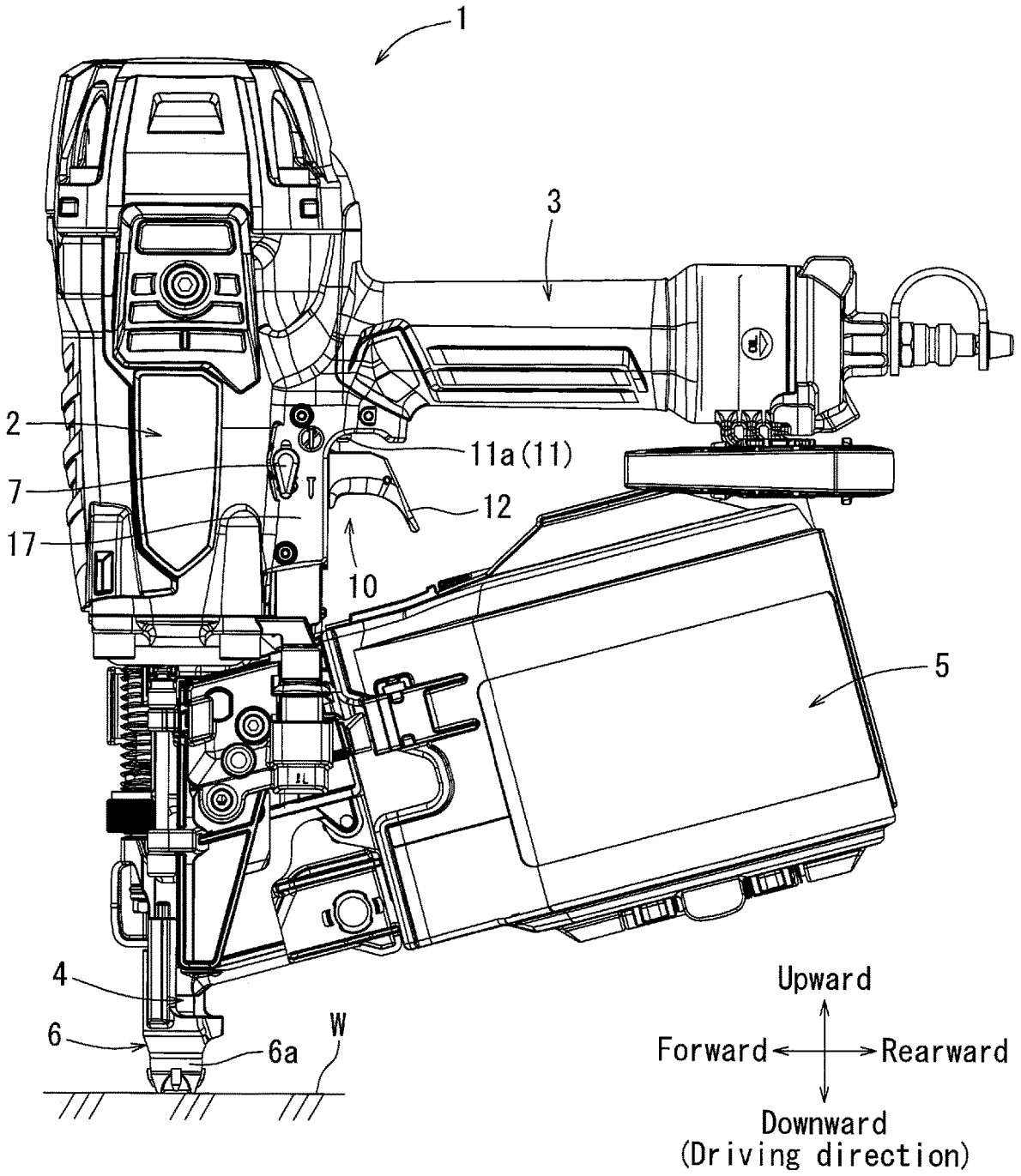
FIG. 1 is an overall side view of a driving tool according to some embodiments of the present invention.
Figure 2:
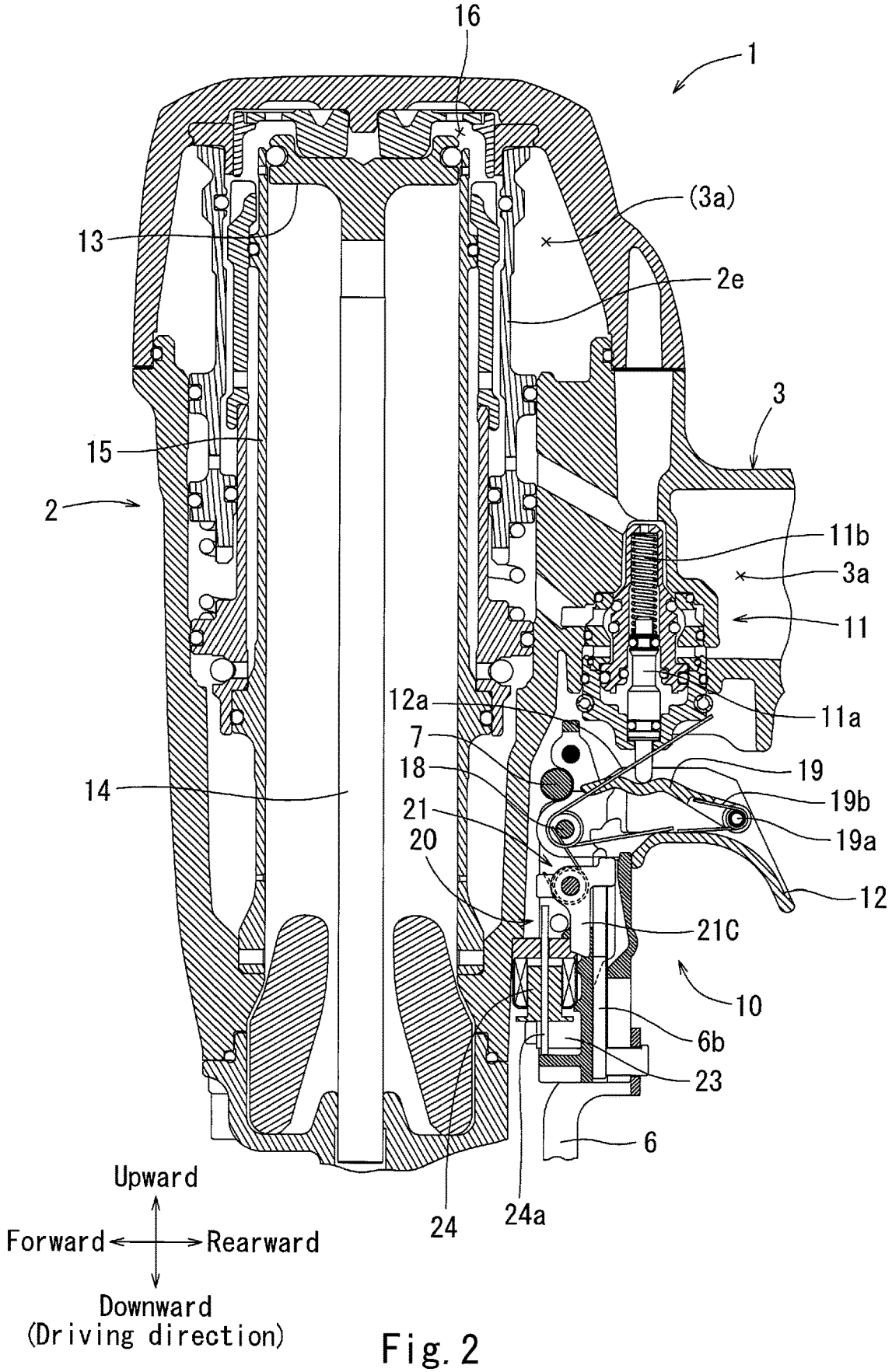
FIG. 2 is a longitudinal sectional view of a tool main body of the driving tool and the starting device according to a first embodiment.
Figure 3:
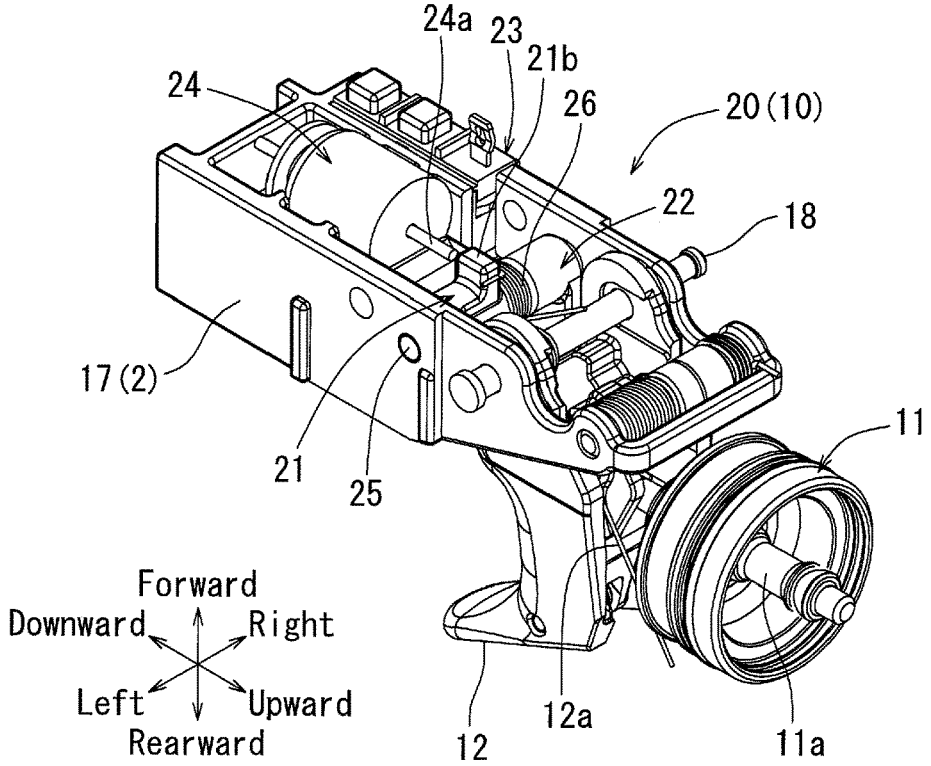
FIG. 3 is a perspective view of the starting device of the first embodiment.
Figure 4:
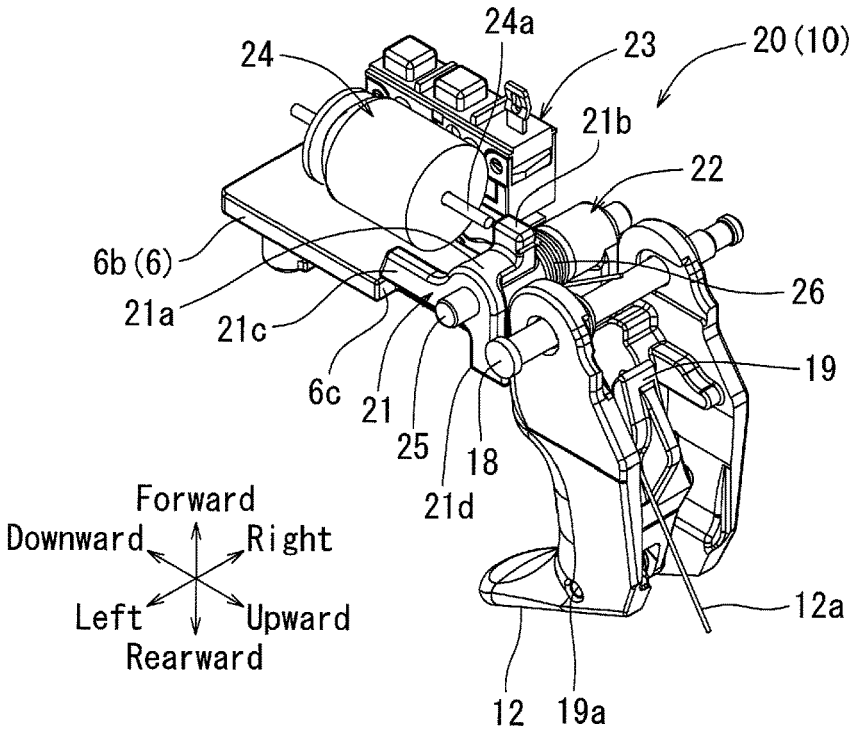
FIG. 4 is a perspective view of the starting device of the first embodiment, and differs from FIG. 3 in that the starter base and the starting valve are omitted.
Figure 5:
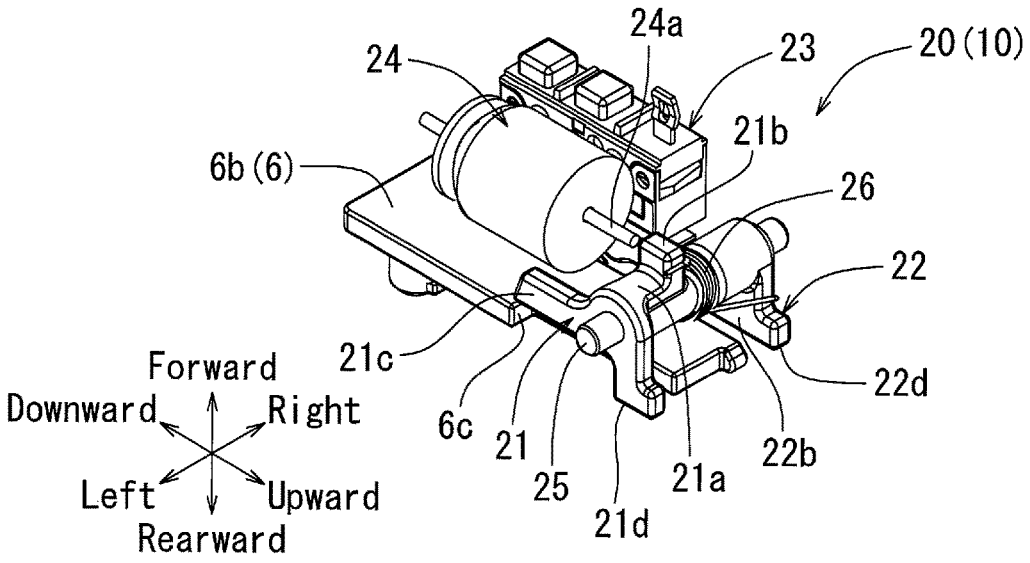
FIG. 5 is a perspective view of a partial configuration of the starting device of the first embodiment, and differs from FIG. 4 in that the trigger and idler are omitted.

Embodiments of the present invention will now be described referring to FIGS. 1 to 27. As shown in FIGS. 1 and 2, in an embodiment, a compressed-air driven nail gun is provided as an example of the driving tool 1. The driving tool 1 includes a tool body 2 incorporating a piston 13 that reciprocates upward/downward within the cylinder 15 using compressed air as the power source. The driving tool 1 also includes a grip 3 extending laterally from a lateral side of the tool body 2 and a nose element 4 extending downward (i.e. in the direction of driving fasteners) from the downward end of the tool body 2. The driving tool 1 further includes a magazine 5 that can load a number of driving fasteners, positioned between the nose element 4 and the grip 3.

A contact arm 6 is supported at the tip of the nose element 4 so as to be relatively movable upward/downward. Pressing the contact arm 6 against the target workpiece W so as to move the contact arm 6 relatively upward is one of the conditions for causing a driving action. The contact arm 6 extends from near the tip of the nose element 4 to near the trigger 12. The contact arm 6 has, at the downward end, an annular contact part **6*a* positioned at the tip of the nose element 4 and positioned around the injection port. The contact arm 6 has, in the upward part, a strip-shaped elongate portion 6*b* extending towards the trigger 12. A contact arm 6 integrally including a contact portion 6*a* and an elongate portion 6*b* is supported along a nose element 4** so as to be vertically movable within an interval.

The starting device 10 of the present embodiment is located near the base of the grip 3 and on the side of the tool body 2. The starting operation of the starting device 10 activates the starting valve 11. When the starting valve 11 is activated, compressed air is supplied to the piston head chamber 16 in the tool body 2. The compressed air supplied to the piston head chamber 16 moves the piston 13 downward in the cylinder 15 to perform a driving action. A long rod-shaped striking driver 14 is attached to the bottom face of the piston 13. As the piston 13 moves downward, the striking driver 14 moves down in the nose element 4, driving a fastener out of the tip (or injection opening) of the nose element 4. Driving fasteners are supplied one by one from the magazine 5 into the nose element 4.

As shown in FIG. 1, a trigger lock lever 7 is located on the side of the starting device 10. When the trigger lock lever 7 is turned downward as shown in FIG. 1, the trigger 12 can be pulled upward. When the trigger lock lever 7 is turned upward, a trigger lock state in which the trigger 12 can not be pulled upward is obtained. By switching the trigger lock lever 7 to the upward, lock position, it is possible to prevent an inadvertent driving action of the driving tool 1.

The present embodiment includes features in the starting device 10 that are not disclosed by the prior art. The other basic configurations of the driving tool 1 are not particularly changed in the present embodiment, and thus detailed description thereof is omitted. The starting device 10 operates to activate the starting valve 11 on the condition that the trigger 12 and contact arm 6 are both activated. The starting device 10 of the present embodiment comprises the above-described starting valve 11 and trigger 12, as well as a timer mechanism 20. As shown in FIG. 2, the starting valve 11 is located inside the grip 3 and on the downward side of the base portion of the grip 3. The downward end of the valve stem 11*a* extends toward the trigger 12. The valve stem 11*a* of the starting valve 11 is supported so as to be movable upward and downward (e.g., between the activated and deactivated positions). The valve stem 11*a* is biased by a compression spring 11*b* down and toward the deactivated position. FIG. 2 shows the valve stem 11*a* in the deactivated position. The starting valve 11 is activated by the upward movement of the valve stem 11*a* from the deactivated position and against the spring biasing force.

When the starting valve 11 is activated, air pressure is allowed to act on the head valve element 2*e*, thereby moving the head valve element 2*e* downward into the opened position. When the head valve element 2*e* is opened, the compressed air accumulated in an accumulation chamber 3*a* located in the grip 3 is supplied to the piston head chamber 16. When the valve stem 11*a* is returned to the downward position by the spring biasing force, the starting valve 11 is deactivated. When the starting valve 11 is deactivated, the head valve element 2*e* is moved upward by the air pressure and the spring force, whereby the piston head chamber 16 is closed off to the accumulation chamber 3*a*. The piston head chamber 16 thus closed off to the accumulation chamber 3*a* is simultaneously opened to the atmosphere. Accordingly, the piston 13 is returned to the upward limit (or initial position).

The details of an embodiment of the trigger 12 and the timer mechanism 20 are shown in FIGS. 3-8. The trigger 12 and the timer mechanism 20 are supported on a starter base 17 that is integrally formed with the rear side of the tool body 2. The trigger 12 is rotatable upward and downward about a support shaft 18. The trigger 12 can be pulled upward (e.g., to the activated position) by the fingertip of the user's hand holding the grip 3. The trigger 12 is biased by the torsion spring 12*a* in such a direction so as to be biased to pivot down toward the deactivated position. An idler 19 is rotatably supported on the back (or upward side) of the trigger 12 by a support shaft 19*a*. The idler 19 is biased by a torsion spring 19*b* in such a direction so as to be biased to move the pivoting tip upward (or forward). The idler 19 is always pressed against the end of the valve stem 11*a* of the starting valve 11 by the biasing force of the torsion spring 19*b*.

A timer mechanism 20 is located below the trigger 12. The elongate portion 6*b* of the contact arm 6 extends and is vertically movable along the rear side of the timer mechanism 20. The timer mechanism 20 includes a contact arm stopper element 21, a switch actuating element 22, a timer switch 23, and an actuator 24. The contact arm stopper element 21 and the switch actuating element 22 are coaxially and independently supported on a support shaft 25 so as to be rotatable in the rearward and forward directions. The contact arm stopper element 21 comprises a cylindrical base portion 21*a*, which is supported by the support shaft 25, integrated with an operation portion 21*b*, a lock receiving portion 21*c*, and a stopper portion 21*d*. The operation portion 21*b* extends generally upward from the right end of the cylindrical base portion 21*a*. The lock receiving portion 21*c* extends generally downward from the left end of the cylindrical base portion 21*a*, and is positioned at an angle of about 90 degrees with respect to the operation portion 21*b* around the axis of the support shaft 25. The stopper portion 21*d* extends generally diagonally and rearward from the left end of the cylindrical base portion 21*a* to the lock receiving portion 21*c* at an interval of about 90 degrees around the axis of the support shaft 25. The operation portion 21*b*, lock receiving portion 21*c*, and stopper portion 21*d* are in a fixed positional relationship about the axis of the cylindrical base portion 21*a*, and are moved integrally around the axis of the support shaft 25.

Figure 8:
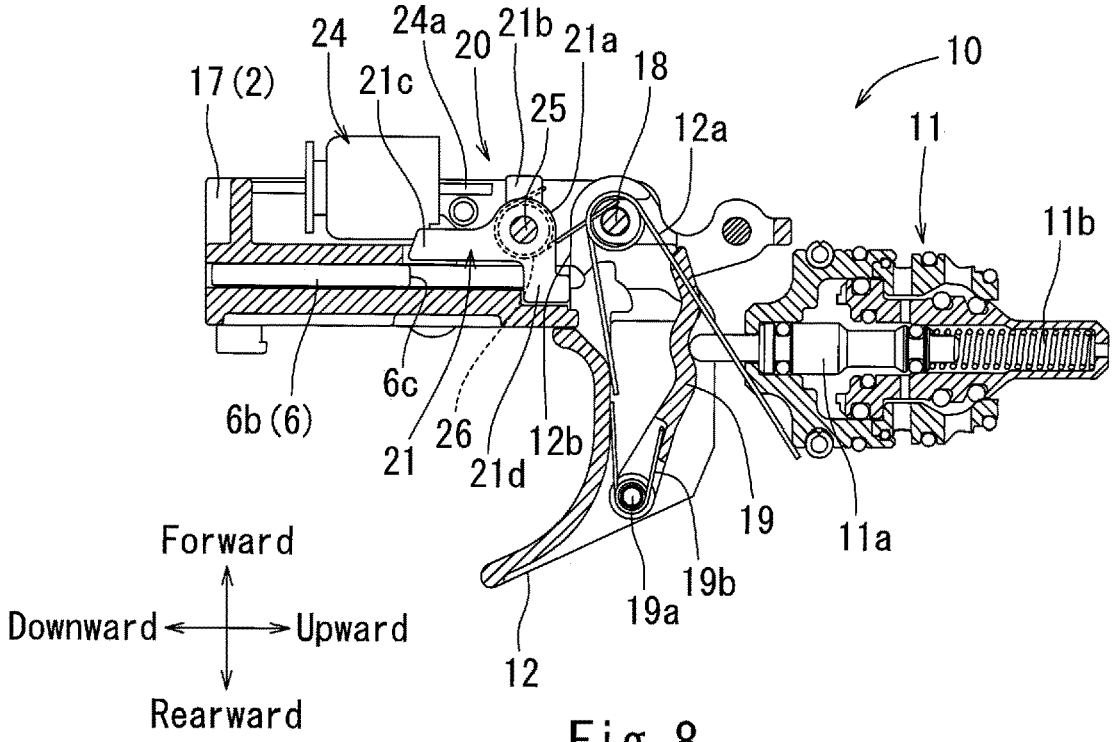
FIG. 8 is a cross-sectional view of the starting device of FIG. 6 at line (VIII)-(VIII), and is a longitudinal cross-sectional view of the starting device of the first embodiment in the initial state. In this figure, the actuator and the contact arm stopper element are shown.

The contact arm stopper element 21 is biased counterclockwise as seen in FIG. 8 (e.g., toward the contact arm locking position) by a torsion spring 26. The trigger 12 has a stopper receiving portion 12*b* at a portion of its downward surface. The stopper receiving portion 12*b* is situated upward of the stopper portion 21*d* of the contact arm stopper element 21. As shown in FIG. 8, when the trigger 12 is in the downward, deactivated position, the stopper receiving portion 12*b* presses the stopper portion 21*d* downward against the biasing force of the torsion spring 26 to hold the contact arm stopper element 21 in the initial, clockwise-rotated position. When the contact arm stopper element 21 is in the initial position, the lock receiving portion 21*c* is offset forward (or upward as seen in FIG. 8) with respect to the elongate portion 6*b* of the contact arm 6.

Figure 15:
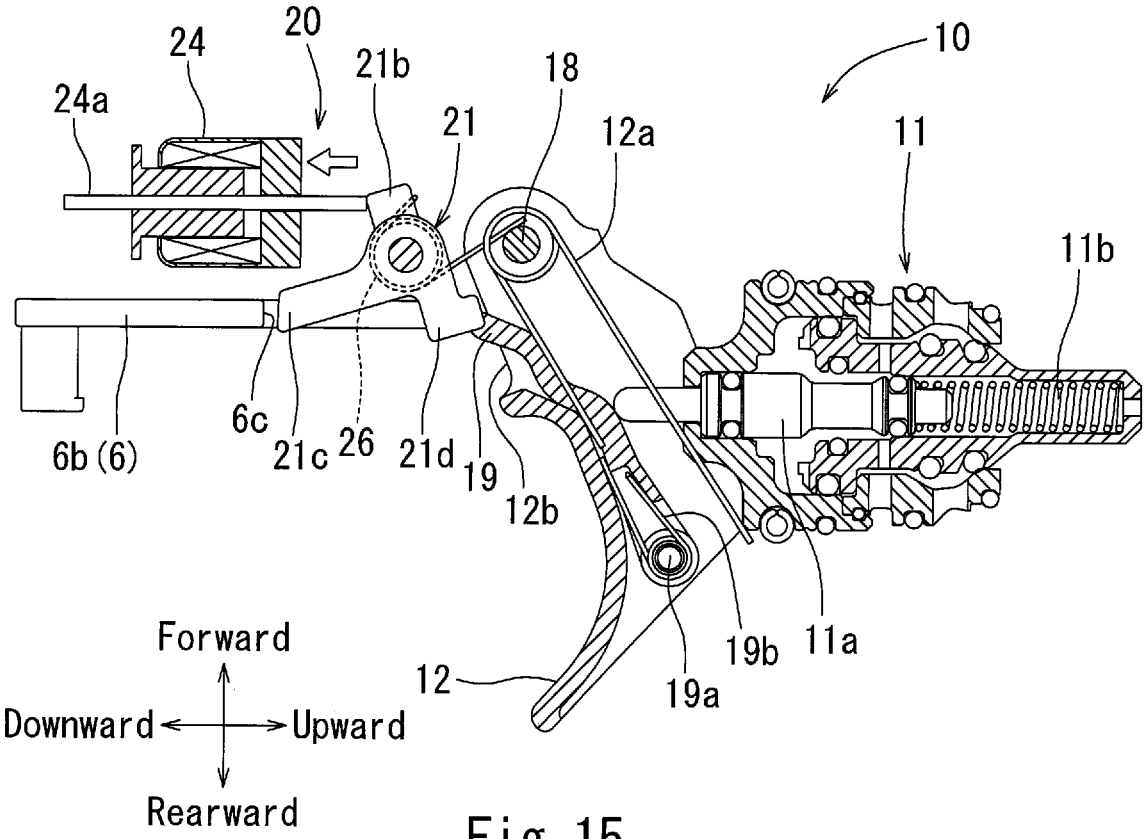
FIG. 15 is a longitudinal sectional view of the starting device of the first embodiment in the state where activation of the contact arm is locked after the reference time since the trigger was activated has passed.
Figure 16:
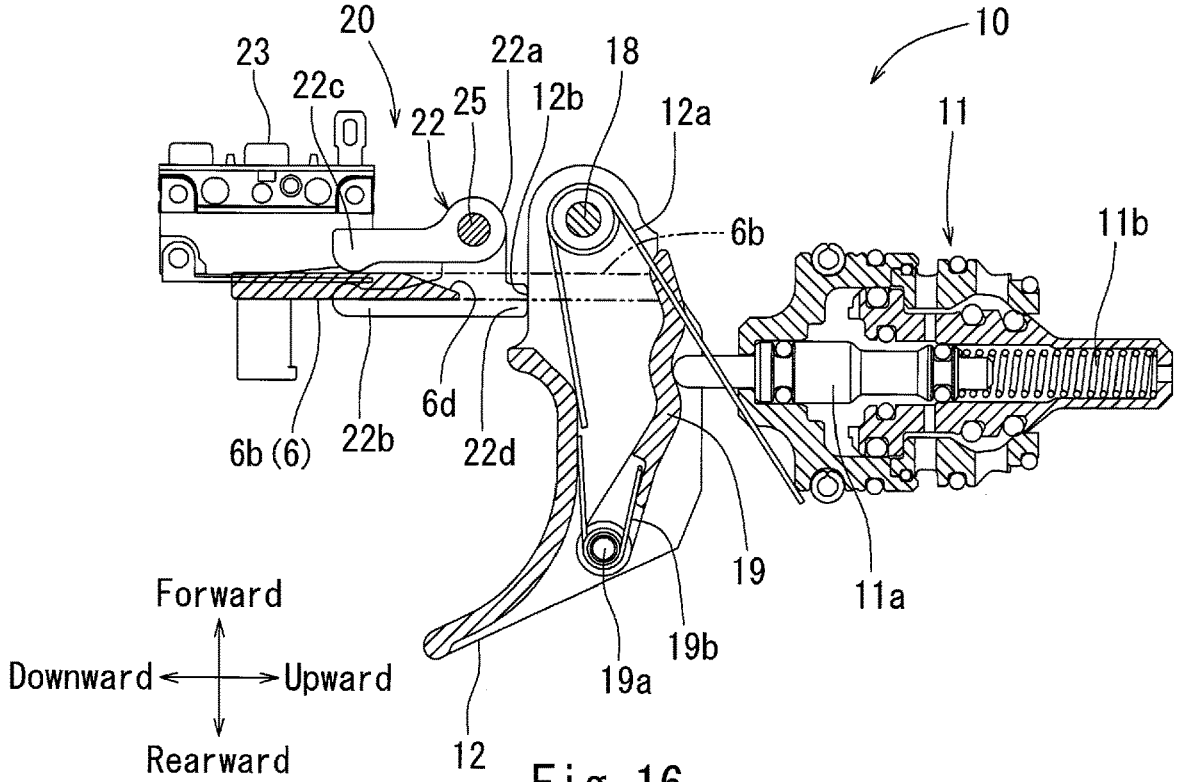
FIG. 16 is a longitudinal cross-sectional view of the starting device of the first embodiment in the state where the contact arm has been activated from the initial state shown in FIG. 9, while the trigger is deactivated.

The contact arm 6 has a lock receiving portion 6*c* and a release guide 6*d* at the elongate portion 6*b*. The lock receiving portion 6*c* is located on the left side of the elongate portion 6*b*. As shown in FIG. 15, which will be described later, when the contact arm stopper element 21 is rotated toward the lock position, the pivoting end of the lock receiving portion 21*c* enters the upward side of the lock receiving portion 6*c*, so as to prevent the contact arm 6 from moving toward the activated position (e.g., the contact arm locking state). As shown in FIG. 16, the release guide 6*d* is located along the right side of the elongate portion 6*b*. The release guide portion 6*d* has a surface inclined in the rearward direction as it goes upward, and acts on the auxiliary arm 22*c* of the switch actuating element 22, described in greater detail below, so that the switch actuating element 22 returns to the switching-off position while the auxiliary arm 22*c* slides on the release guide portion 6*d*.

Figure 6:
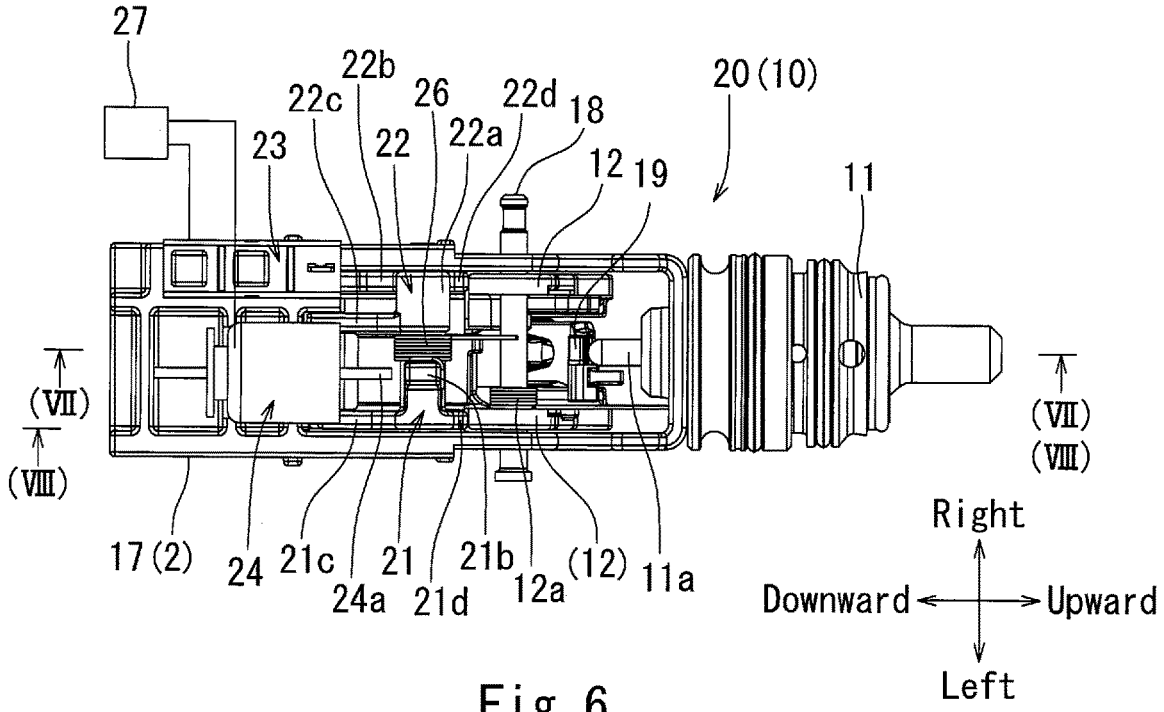
FIG. 6 is an upper view of the starting device of the first embodiment.
Figure 7:
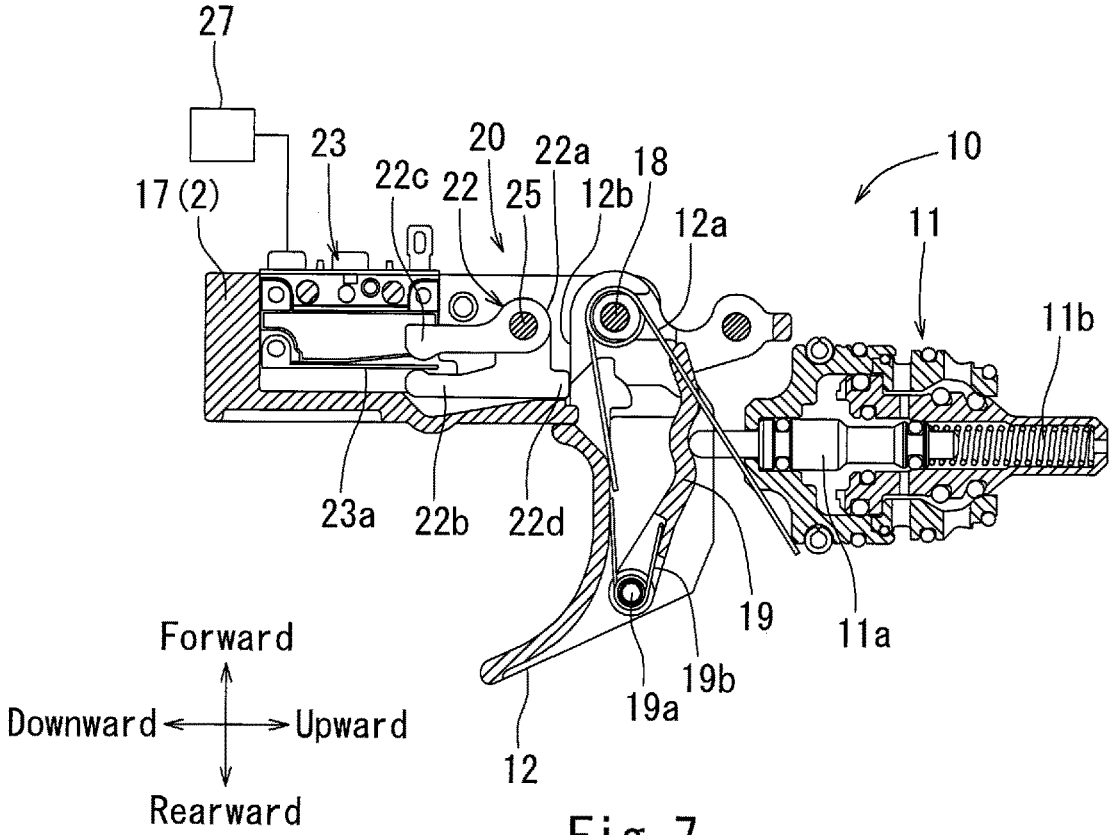
FIG. 7 is a cross-sectional view of the starting device of FIG. 6 at line (VII)-(VII), and is a longitudinal cross-sectional view of the starting device of the first embodiment in the initial state. In this figure, the timer switch and the switch actuating element are shown.
Figure 11:
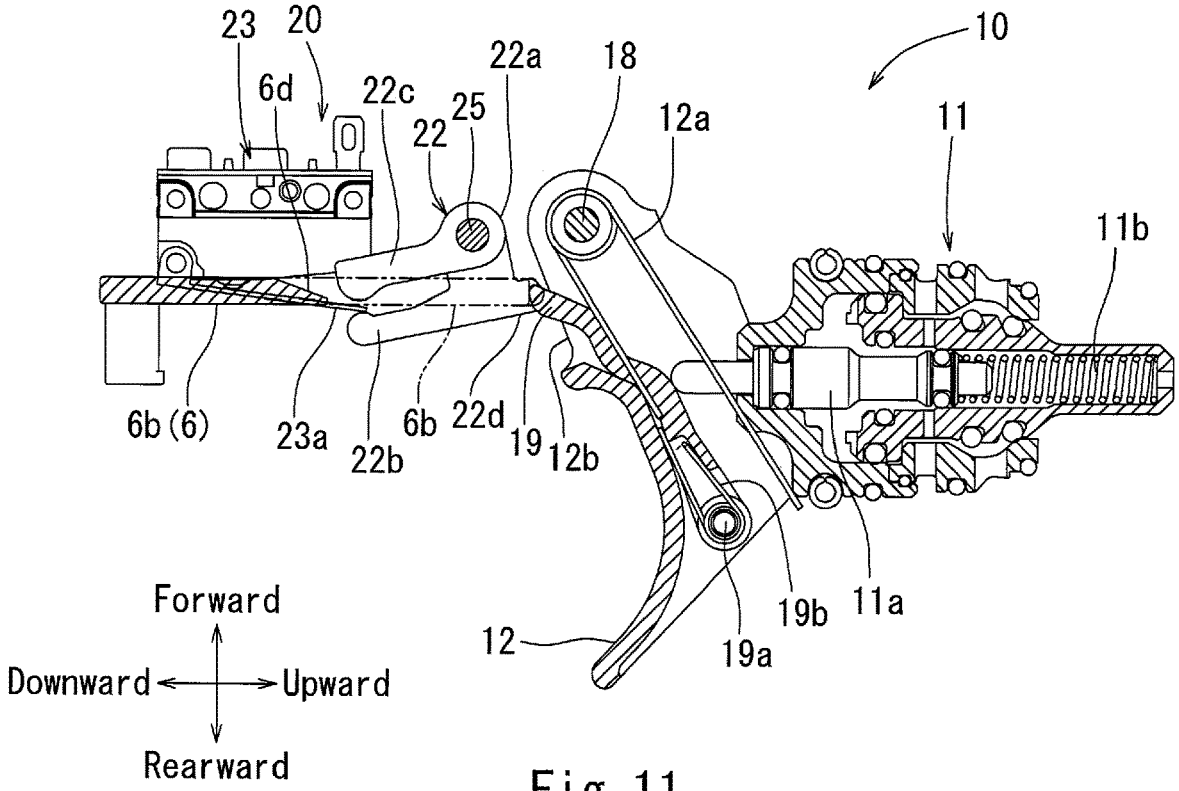
FIG. 11 is a longitudinal cross-sectional view of the starting device of the first embodiment in the state where the trigger has been activated from the initial state shown in FIG. 9, while the contact arm is deactivated.

The switch actuating element 22 supported on the right side of the contact arm stopper element 21 comprises a cylindrical base portion 22*a*, which is supported by the support shaft 25, integrated with an actuating arm 22*b* and an auxiliary arm 22*c*. The actuating arm 22*b* and auxiliary arm 22*c* extend downward from the cylindrical base portion 22*a* and are parallel to each other. As shown in FIG. 6, the actuating arm 22*b* is located on the right end of the cylindrical base portion 22*a*. The auxiliary arm 22*c* is offset to the left relative to the actuating arm 22*b*. The actuating arm 22*b* has an integrated stopper portion 22*d* on the upward end. As shown in FIG. 7, when the trigger 12 is in the deactivated position, the stopper receiving portion 12*b*, located in the forward surface of the trigger 12, presses the stopper portion 22*d* downward to keep the switch actuating element 22 in the switching-off position. When the trigger 12 is pulled upward, the stopper receiving portion 12*b* moves upward, thereby allowing the switch actuating element 22 to be rotatable in the counterclockwise direction of FIG. 7. As shown in FIG. 11, which will be discussed later, the counterclockwise rotation of the switch actuating element 22 turns on the timer switch 23.

Figure 12:
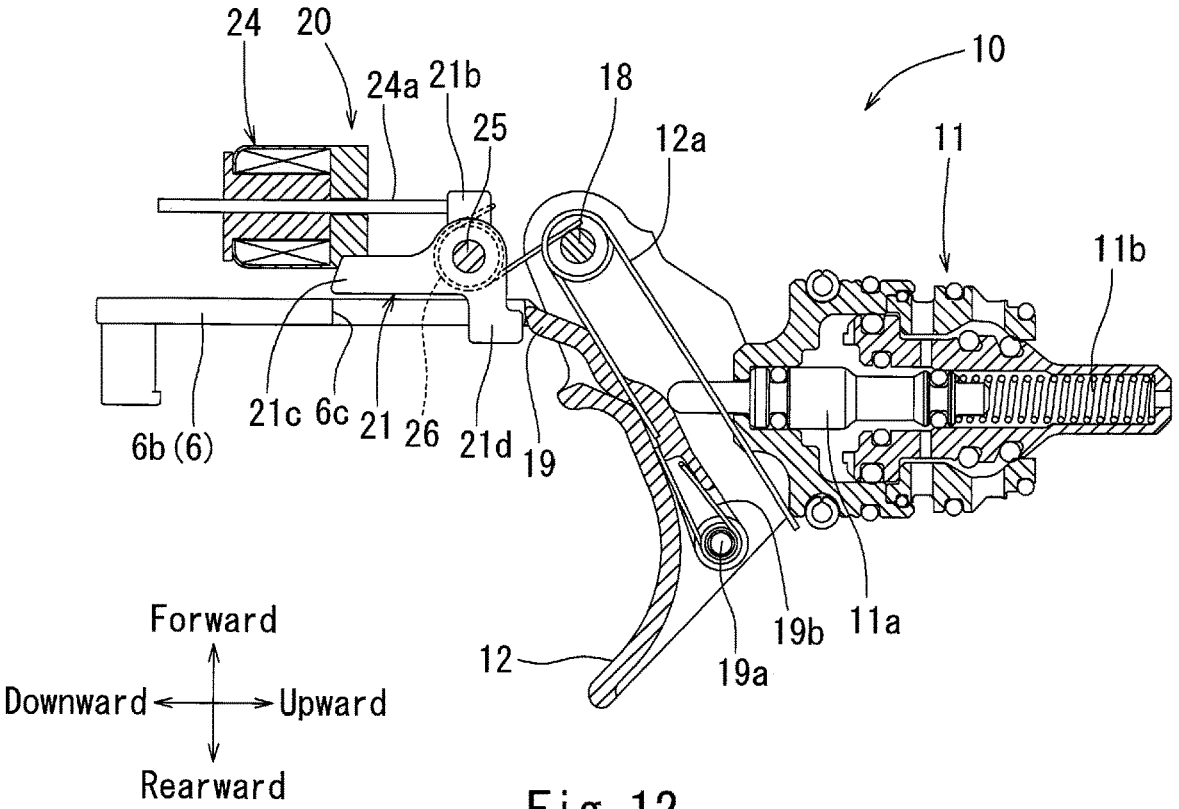
FIG. 12 is a longitudinal cross-sectional view of the starting device of the first embodiment in the state where the trigger has been activated from the initial state shown in FIG. 10, while the contact arm is deactivated.

As shown in FIGS. 3 to 8, the actuator 24 is located downward of the contact arm stopper element 21. The timer switch 23 is located downward of the switch actuating element 22. In the present embodiment, the actuator 24 is an electromagnetic actuator configured, when energized, to move the actuating shaft 24*a* in the axial direction. When the actuator 24 is energized, the actuating shaft 24*a* is moved upward. The actuating shaft 24*a* extends toward the operation portion 21*b* of the contact arm stopper element 21. The upward movement of the actuating shaft 24*a* of the energized actuator 24 prevents the downward movement of the operation portion 21*b*. This prevents the contact arm stopper element 21 from pivoting toward the lock position (and thereby the contact arm 6 is permitted to be activated). FIG. 12, which will be discussed later, shows the actuating shaft 24*a* abutting the operation portion 21*b* to prevent the downward movement.

In the present embodiment, the timer switch 23 is a normally-closed type microswitch having an switch lever 23*a*. The timer switch 23 is turned off when the switch lever 23*a* is moved upward, and turned on when the switch lever 23*a* is returned downward. As described above, when the deactivated trigger 12 presses the stopper portion 22*d* of the switch actuating element 22, the switch actuating element 22 is held in the switching-off position. In the switching-off position, the actuating arm 22*b* is moved forward to push the switch lever 23*a* of the timer switch 23 forward, thereby keeping the timer switch 23 turned off. FIG. 7 shows the timer switch 23 turned off.

The controller 27 including a control circuit determines the on/off state of the timer switch 23. When turned on by activation of the trigger 12, the timer switch 23 enters a turned-on state and the controller 27 starts to measure the time elapsed. Further, when the timer switch 23 is turned on, the actuator 24 is energized, causing the actuating shaft 24*a* to move upward. This position of the actuator 24 prevents the contact arm stopper element 21 from rotating toward the lock position. When the time duration of the turned-on state of the timer switch 23 measured by the controller reaches a reference time t preset in the controller, the actuator 24 is deenergized. When the actuator 24 is deenergized, the actuating shaft 24*a* is moved downward, and the contact arm stopper element 21 is pivoted to the lock position by the biasing force of the torsion spring 26. When the contact arm stopper element 21 pivots to the lock position, the lock receiving portion 21*c* moves rearward, thereby preventing the contact arm 6 from being activated.

Activation of both the trigger 12 and contact arm 6 causes the idler 19 to push the valve stem 11*a* upward to activate the starting valve 11. As described above, when the starting valve 11 is activated, compressed air is supplied to the piston head chamber 16 to cause a driving action. For example, in the driving work mode in which the trigger 12 is activated first and then the contact arm 6 is activated (what is called the shaking method), the activation of the contact arm 6 is prohibited after the reference time t, set by the timer mechanism 20, from the activation of the trigger 12 has passed. The prohibition state of activation of the contact arm 6 is removed by release of the activated trigger 12. As another example, in the driving work mode in which the contact arm 6 is activated first and then the trigger 12 is activated (what is called the aiming method), no time limit is set by the timer mechanism 20. The operational states of the timer mechanism 20 for each work mode will be described below.

Figure 9:
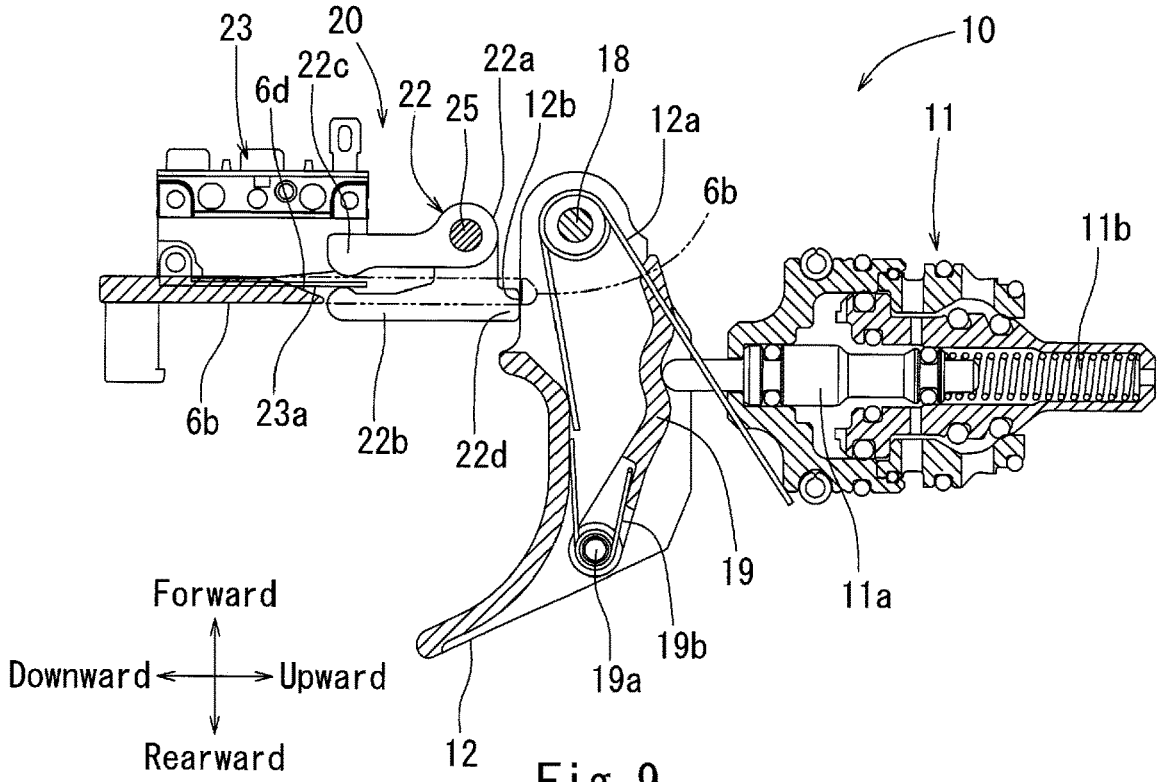
FIG. 9 is a longitudinal cross-sectional view of the starting device of the first embodiment in the initial state as depicted in FIG. 7, and differs from FIG. 7 in that the starter base is omitted and the elongate portion of the contact arm is additionally shown.
Figure 10:
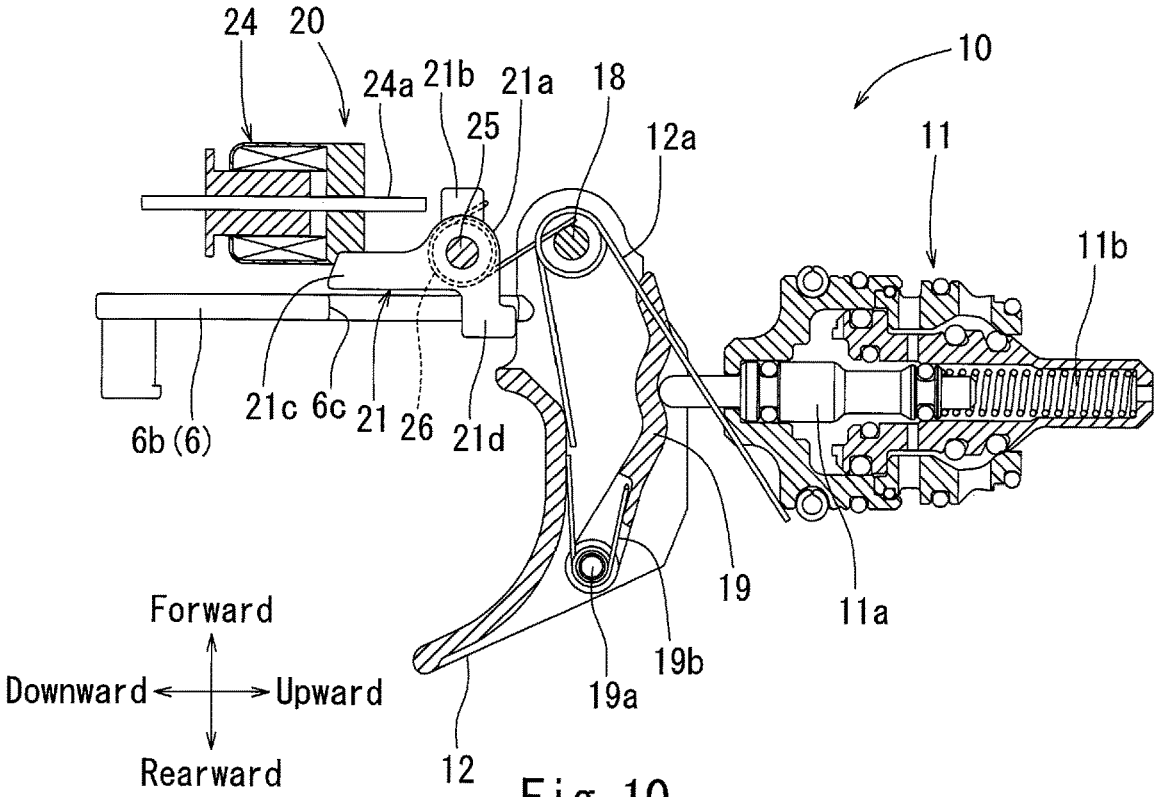
FIG. 10 is a longitudinal cross-sectional view of the starting device of the first embodiment in the initial state as depicted in FIG. 8, and differs from FIG. 8 in that the starter base is omitted and the solenoid valve is shown in a longitudinal cross-section.

When the trigger 12 in the initial position, as shown in FIGS. 9 and 10, is pulled upward, as shown in FIGS. 11 and 12, the timer mechanism 20 is operated. As shown in FIG. 11, when the trigger 12 is pulled upward, the stopper receiving portion 12*b* moves upward. This allows the switch actuating element 22 to be rotatable counterclockwise as seen in FIG. 11. When the switch actuating element 22 is rotatable counterclockwise as shown, the actuating arm 22*b* can move downward. The switch lever 23*a* of the timer switch 23 is in contact with the upward side of the actuating arm 22*b*. The switch lever 23*a* is spring biased toward the turned-on position (i.e. in the downwardly pivoting direction). Therefore, when the trigger 12 is activated to allow for rotation of the switch actuating element 22 in the counterclockwise direction, the switch lever 23*a* of the timer switch 23 is rotated rearward to turn on the timer switch 23.

When the timer switch 23 is turned on, the actuator 24 is energized as shown in FIG. 12, so as to move the actuating shaft 24*a* upward. Further, when the timer switch 23 is turned on, the controller 27 starts to measure the turn-on time of the timer switch 23 (i.e. the activation time of the trigger 12). If the contact arm 6 is activated, as shown in FIGS. 13 and 14, before the turned-on time of the timer switch 23 as measured by the controller 27 has passed, within the preset reference time t, the idler 19 is moved further upward to activate the starting valve 11, causing a driving action in the tool body 2.

Figure 13:
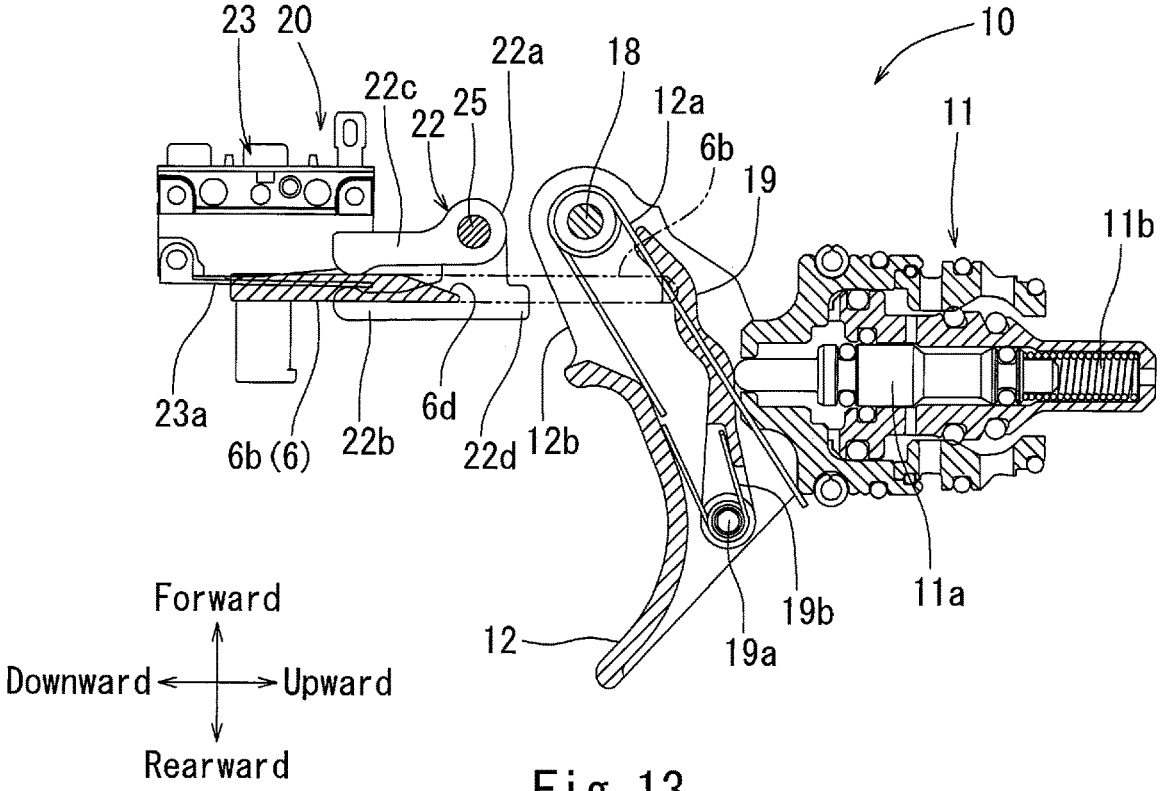
Figure 14:
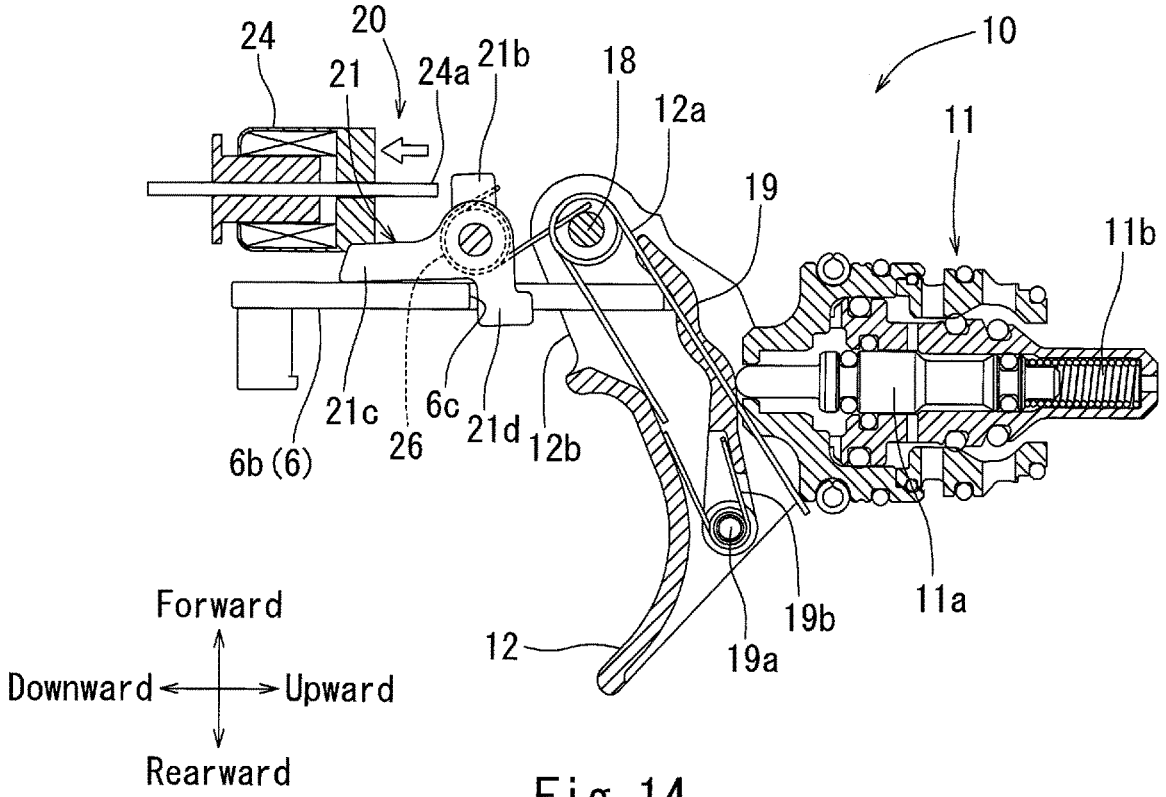

As shown in FIG. 13, when the contact arm 6 is activated within the reference time t, the release guide 6*d* of the contact arm 6 pushes the auxiliary arm 22*c* upward. When the auxiliary arm 22*c* is pushed upward, the actuating arm 22*b* is also moved upward. The upward movement of the actuating arm 22*b* acts to push the switch lever 23*a* upward, thereby turning off the timer switch 23. When the timer switch 23 is turned off, the measurement of the active time of the trigger 12 is stopped and thus the timing operation is canceled.

When the contact arm 6 is activated within the reference time t and the timer switch 23 is turned off, the actuator 24 is deenergized. When the actuator 24 is deenergized, the actuating shaft 24*a* returns to the downward, initial position, as shown in FIG. 14. When returned to the initial position, the actuating shaft 24*a* of the actuator 24 no longer prevents the contact arm stopper element 21 from rotating counterclockwise (toward the lock position). At this time, however, the lock receiving portion 21*c* rests on the upward surface of the elongate portion 6*b* of the contact arm 6. Accordingly, the contact arm stopper element 21 is prevented from rotating counterclockwise (toward the lock position).

On the other hand, if no activation of the contact arm 6 occurs within the reference time t of the trigger 12 being pulled upward, as shown in FIG. 11 and FIG. 12, the actuator 24 is deenergized upon reaching the reference time t, regardless of the turned-on state of the timer switch 23. As shown in FIG. 15, when the actuator 24 is deenergized, the actuating shaft 24*a* returns to the downward, initial position, allowing the contact arm stopper element 21 to rotate in the counterclockwise direction as seen in the figure (toward the lock position). When the contact arm stopper element 21 rotates to the lock position, the lock receiving portion 21*c* moves rearward to enter an upward portion of the passage of the lock receiving portion 6*c*. When the lock receiving portion 21*c* is positioned upward of the lock receiving portion 6*c*, the activation of the contact arm 6 is prohibited. The prohibition of the activation of the contact arm 6 is removed (i.e. the starting device 10 is restored to the initial state) by the deactivation of the trigger 12. Deactivation of the trigger 12 causes the stopper receiving portion 12*b* to push the stopper portion 21*d* downward, thereby returning the contact arm stopper element 21 to the unlock position.

In summary, if the trigger 12 is activated before the contact arm 6, then the contact arm 6 can be activated within the reference time t to cause a driving action. However, activation of the contact arm 6 is prohibited after the reference time t is reached. This prevents an inadvertent driving action when the driving tool 1 is carried with the trigger 12 being pulled.

As described above, if the trigger 12 is activated first, the timer mechanism 20 operates so as to inhibit inadvertent driving actions occurring in the tool body 2. The driving tool 1 of the present embodiment can also perform driving actions when the contact arm 6 is activated first. When the contact arm 6 is activated earlier than the trigger 12, the timer mechanism 20 does not operate. It is less likely that an inadvertent driving action would occur if contact arm 6 is activated before the trigger 12, as this order of activations indicates a clear intention to perform a driving action.

Figure 17:
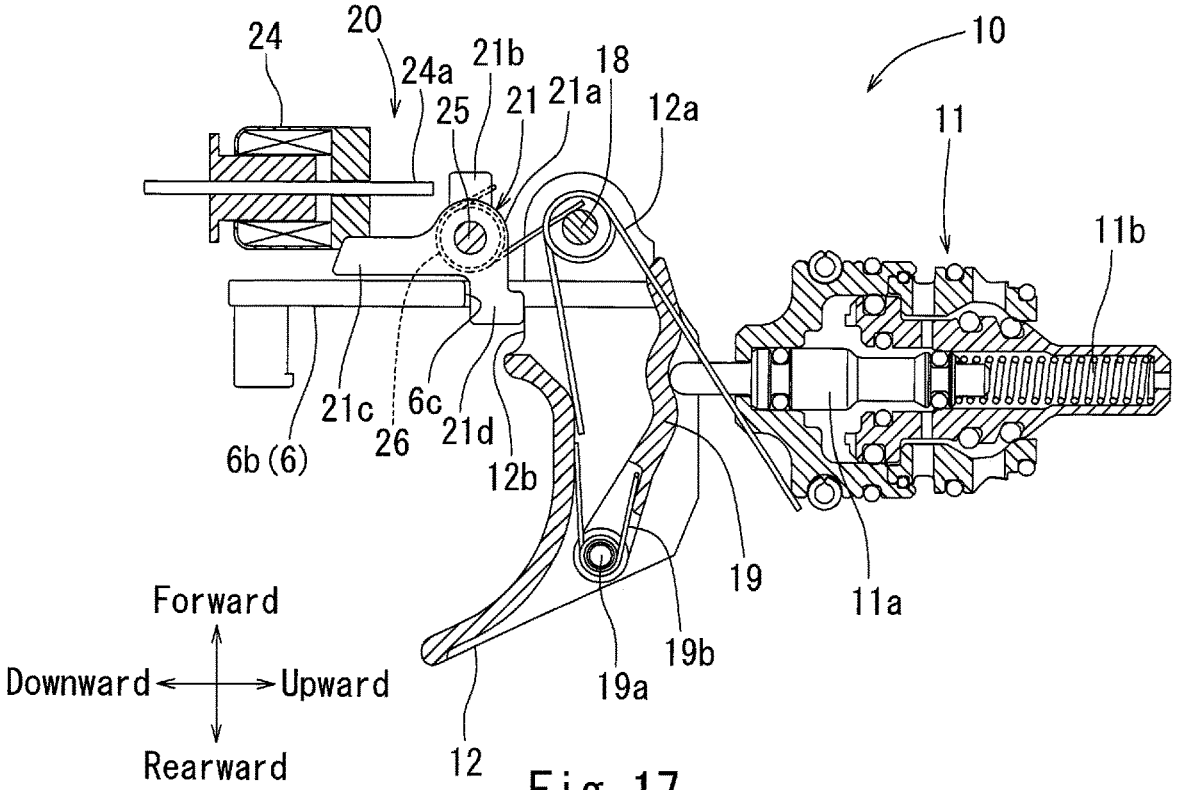
FIG. 17 is a longitudinal cross-sectional view of the starting device of the first embodiment in the state where the contact arm has been activated from the initial state shown in FIG. 10, while the trigger is deactivated.

The contact arm 6 in the initial position, as shown in FIGS. 9 and 10, may be activated before the trigger 12, as shown in FIGS. 16 and 17. When the trigger 12 is in the initial, non-activated state, as shown in FIG. 17, the stopper receiving portion 12*b* presses the stopper portion 21*d* downward, thereby holding the contact arm stopper element 21 in the initial position. This allows the contact arm 6 to be activated. At this stage, since the trigger 12 is not yet activated, as shown in FIG. 16, the stopper receiving portion 12*b* also presses the stopper portion 22*d* downward, thereby also holding the switch actuating element 22 in the initial position. As a result of the switch actuating element 22 being held in the initial position, the switch lever 23*a* is pressed upward. Thus, the timer switch 23 is held in the off state. Since the timer switch 23 is not turned on, the time duration of the deactivated state of the contact arm 6 is not measured.

Figure 18:
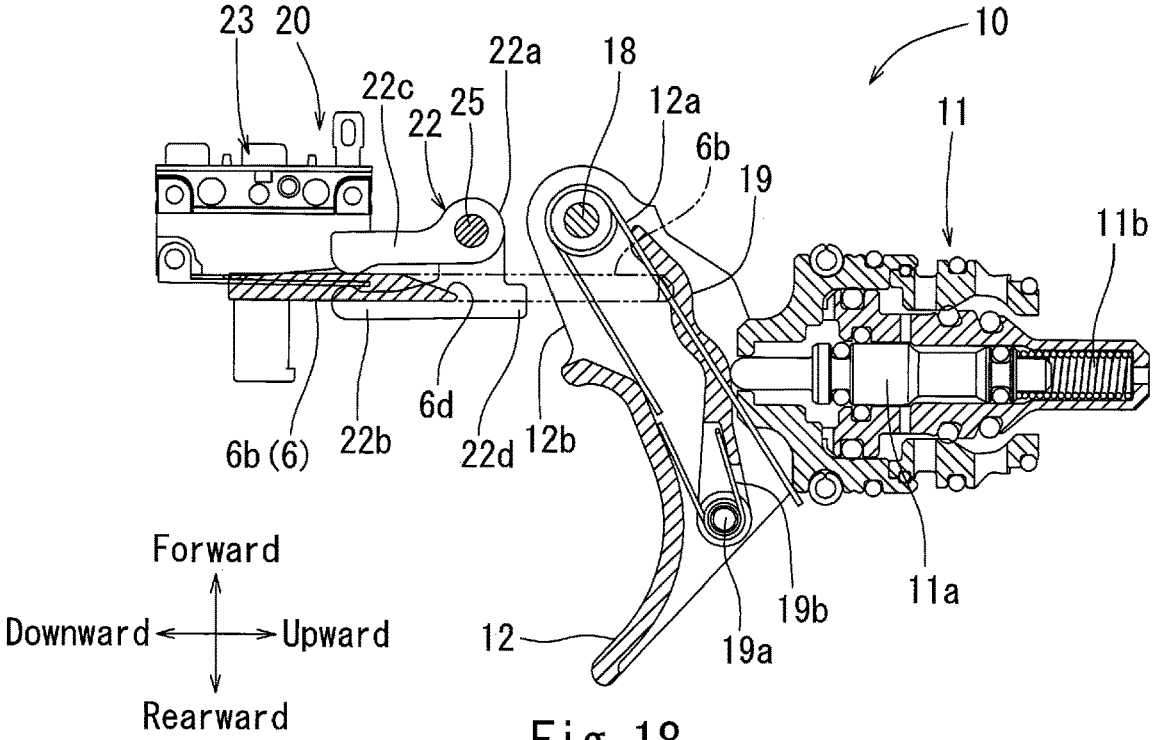
FIG. 18 is a longitudinal cross-sectional view of the starting device of the first embodiment in the state where the trigger has been subsequently activated from the state shown in FIG. 16 and where the starting valve has been activated.
Figure 19:
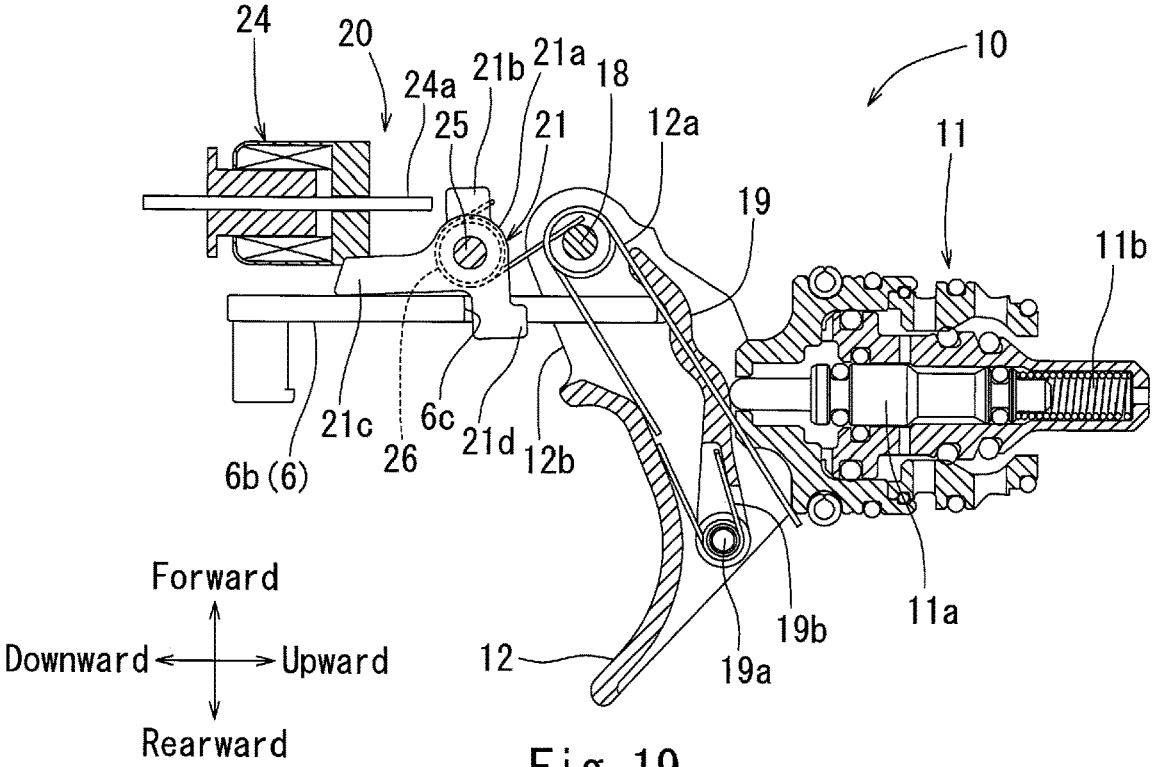
FIG. 19 is a longitudinal cross-sectional view of the starting device of the first embodiment in the state where the trigger has been subsequently activated from the state shown in FIG. 17 and where the starting valve is activated.

After the contact arm 6 is activated, when the trigger 12 is subsequently activated, as shown in FIGS. 18 and 19, the valve stem 11*a* is pushed upward and the starting valve 11 is activated. The activation of the starting valve 11 causes a driving action in the tool body 2. After the driving action is performed, the trigger 12 and the contact arm 6 can be returned to their respective deactivated position, to restore the starting device 10 and the driving tool 1 to the initial state.

Alternatively, when only the contact arm 6 is deactivated while the trigger 12 is still being activated after a driving action was performed, the same state as shown in FIGS. 11 and 12 results. Accordingly, the timer mechanism 20 begins to operate. More specifically, the auxiliary arm 22*c* of the switch actuating element 22 disengages from the top surface of the contact arm 6. This allows the switch actuating element 22 to rotate to the on position. The rotation of the switch actuating element 22 to the on position turns on the timer switch 23. The timer mechanism 20 then operates and the measurement of the time duration of the deactivated state of the contact arm 6 is started.

Furthermore, when the timer switch 23 is turned on, the actuator 24 is energized within the reference time t. When the actuator 24 is energized, the actuating shaft 24*a* moves upward to abut the operation portion 21*b*. This prevents the contact arm stopper element 21 from moving toward the lock position. The prevention of the movement of the contact arm stopper element 21 to the lock position results in the contact arm 6 being allowed to be activated. The driving action can then be performed by re-activating the contact arm 6 before the reference time t has passed. After the reference time t has been reached, as shown in FIG. 15, activation of the contact arm 6 is prohibited, and thus an inadvertent driving action is prevented.

As described above, the prohibition of driving actions (or prohibition of activation of the contact arm 6) by the timer mechanism 20 can be removed by releasing the trigger 12. When the trigger 12 is returned to the deactivated position, the stopper receiving portion 12*b* pushes the stopper portion 22*d* of the switch actuating element 22 downward. This moves the actuating arm 22*b* upward to turn the timer switch 23 off, resulting in the actuating device 10 being restored to the initial state as shown in FIG. 9.

In the starting device 10 of the first embodiment configured as discussed above, the timer mechanism 20 operates if the trigger 12 is activated and the contact arm 6 is not activated. Accordingly, after the reference time t has been reached, an inadvertent driving action by an accidental contact of the contact arm 6 with some other object while, for example, when the driving tool 1 is carried with the trigger 12 being activated, is prevented.

Furthermore, the timer mechanism 20, described as an example, does not include any compressed-air powered pneumatic device, but instead an electrically-powered electromagnetic actuator. Accordingly, the operation of each of its parts is more agile (and responsive), resulting in higher work efficiency with the driving tool 1 (e.g., increased rapid-firing performance). Furthermore, as shown in FIGS. 16 to 19, if the contact arm 6 is activated first, driving actions can be performed without requiring power supply to the actuator 24. Accordingly, the driving tool 1 can be used even under the condition where no power is being supplied, thus allowing the driving work to be continued in the event of a sudden power cutoff or depletion of the power source.

Various modifications to the embodiment described above are possible. For example, FIGS. 20-27 show a starting device 10 including a second embodiment of a timer mechanism 30. The timer mechanism 30 of the second embodiment omits the switch actuating element 22 of the first embodiment. For this reason, the release guide 6*d* of the contact arm 6 is also omitted. On the other hand, the second embodiment includes a contact arm switch 32 directly detecting activation of the contact arm 6. Elements and features which do not require any change will be associated with like reference symbols, and their description will be omitted for the sake of brevity.

Figure 20:
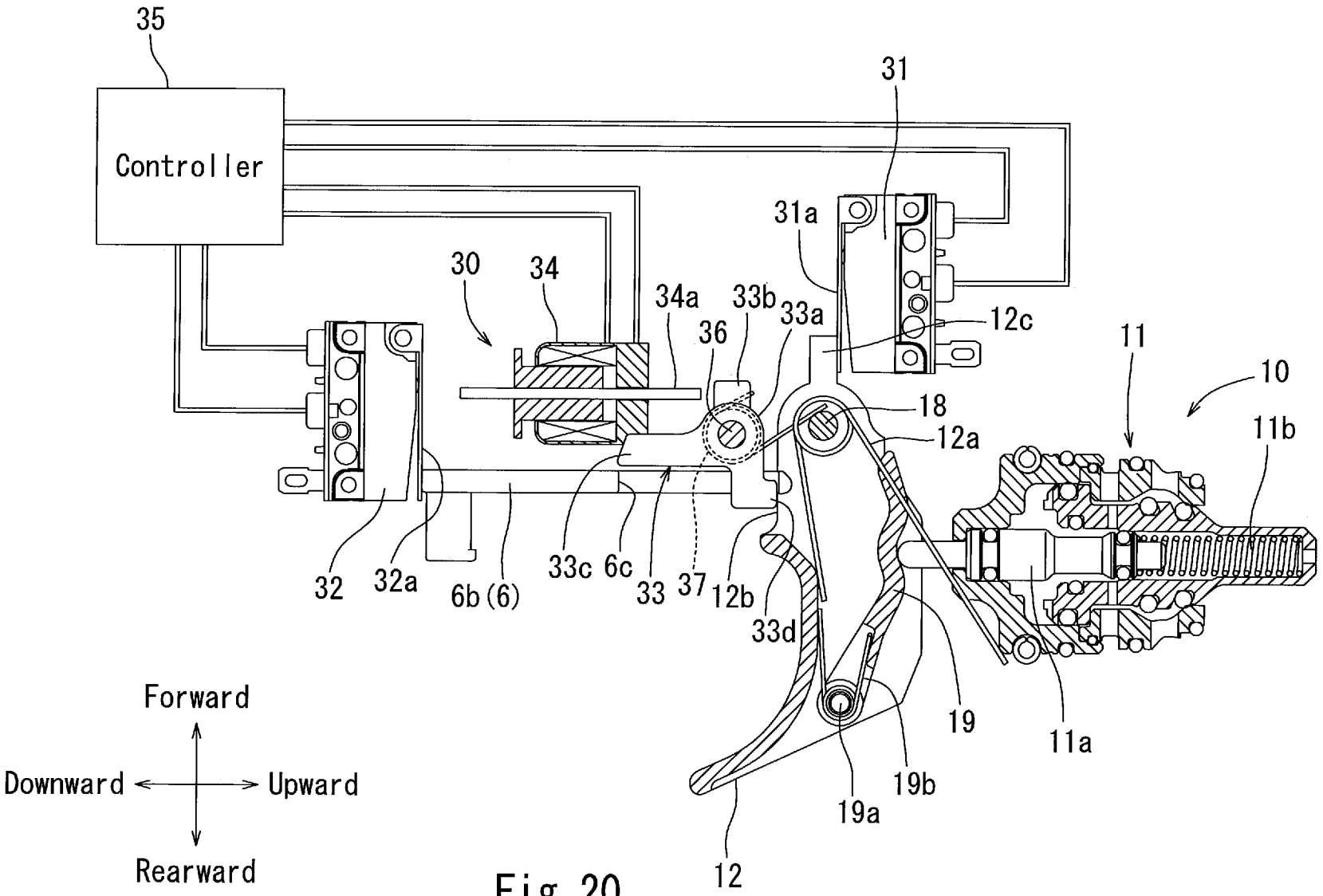
FIG. 20 is a longitudinal cross-sectional view of the starting device according to a second embodiment in the initial state. In the figure, a controller as control means is schematically shown.

As shown in FIG. 20, the timer mechanism 30 of the second embodiment includes a trigger switch 31 directly detecting activation of the trigger 12, a contact arm switch 32 directly detecting activation of the contact arm 6, and a contact arm stopper element 33 for blocking activation of the contact arm 6, and an actuator 34 for blocking the contact arm stopper element 33 from moving toward the stopping position, and a controller 35 for supplying power to the actuator 34 based on detection of the signals from the trigger control 31 and contact arm switch 32.

The second embodiment is different from the first embodiment in that activation of the trigger 12 and contact arm 6 is separately detected by the trigger switch 31 and contact arm switch 32, respectively. A switch actuating portion 12*c* is positioned forward of the trigger 12. The operating lever 31*a* of the trigger switch 31 is in contact with the switch actuating portion 12*c*. When the trigger 12 is activated, the switch actuating portion 12*c* moves downward to turn on the trigger switch 31. When the trigger 12 is released to the deactivated position, the operating lever 31*a* is pushed upward to turn off the trigger switch 31. The trigger switch 31 is a normally-closed microswitch.

The contact arm switch 32 is positioned downward of the elongate portion 6*b*. The operating lever 32*a* of the contact arm switch 32 is in contact with the downward end of the elongate portion 6*b*. When the contact arm 6 is in the deactivated position, the downward end of the elongate portion 6*b* presses the operating lever 32*a* downward to keep the contact arm switch 32 turned off. When the contact arm 6 is moved relatively upward, and thus activated, the elongate portion 6*b* integrally moves upward. This causes the operating lever 32*a* to also move upward, thereby turning on the contact arm switch 32. The contact arm switch 32 is also a normally-closed microswitch.

The controller 35 determines the on/off state of the trigger switch 31 and contact arm switch 32. The controller 35 measures the time during which the trigger switch 31 is on and the contact arm switch 32 is off (hereinafter referred to as the monitoring time). The controller 35 controls such that the actuator 34 is powered when the monitoring time is within a preset reference time t. When the actuator 34 is powered, activation of the contact arm 6 is not prohibited (the driving action non-prohibition state), as will be described below. When the contact arm 6 is activated and thus the contact arm switch 32 is turned on before the reference time t has been reached, measurement of the monitoring time is stopped and the timer mechanism 30 is reset.

The contact arm stopper element 33 includes a cylindrical base portion 33*a* integrated with an actuating portion 33*b*, a lock arm 33*c*, and a stopper portion 33*d*, and, in a similar manner to the first embodiment, is rotatably supported by the support shaft 36. The contact arm stopper element 33 is biased by a torsion spring 37 in the direction of moving the lock arm 33*c* rearward. As shown in FIG. 20, in the initial state where the trigger 12 is not activated, the stopper receiving portion 12*b* presses the stopper portion 33*d* downward. This holds the contact arm stopper element 33 in the unlock position, where the lock arm 33*c* is retracted to the forward side from the passage of the contact arm 6. The contact arm stopper element 33 is held in the unlock position against the biasing force of the torsion spring 37.

When the actuator 34 is not energized, the actuating shaft 34*a* is returned downward. When the actuator 34 is energized, the actuating shaft 34*a* moves upward so that its upward end abuts the actuating portion 33*b* of the contact arm stopper element 33. When the actuating shaft 34*a* of the actuator 34 contacts the actuating portion 33*b*, the contact arm stopper element 33 is locked in the unlock position. When the actuator 34 is deenergized, causing the actuating shaft 34*a* to be returned to the downward, initial position, the contact arm stopper element 33 can be rotated to the lock position by the biasing force of the torsion spring 37. When the contact arm stopper element 33 is pivoted to the lock position, the lock arm 33*c* enters an upward side of the lock receiving portion 6*c* of the contact arm 6. In the state where the lock arm 33*c* is in the passage of the lock receiving portion 6*c*, activation of the contact arm 6 is prohibited. The prohibition of the activation of the contact arm 6 is canceled by deactivating the trigger 12 to turn off the trigger switch 31. This restores the starting device 10 to the initial state.

The operational states of the starting device 10 that includes the timer mechanism 30 of the second embodiment are substantially the same as those of the starting device 10 that includes the timer mechanism 20 of the above-described first embodiment. These operational states will be briefly reiterated below. FIG. 20 shows an initial state of the starting device 10 with the timer mechanism 30 of the second embodiment. The controller 35 is omitted in FIGS. 21-27. The starter base 17 is also omitted. Only the elongate portion 6*b* of the contact arm 6 is shown in these figures.

Figure 21:
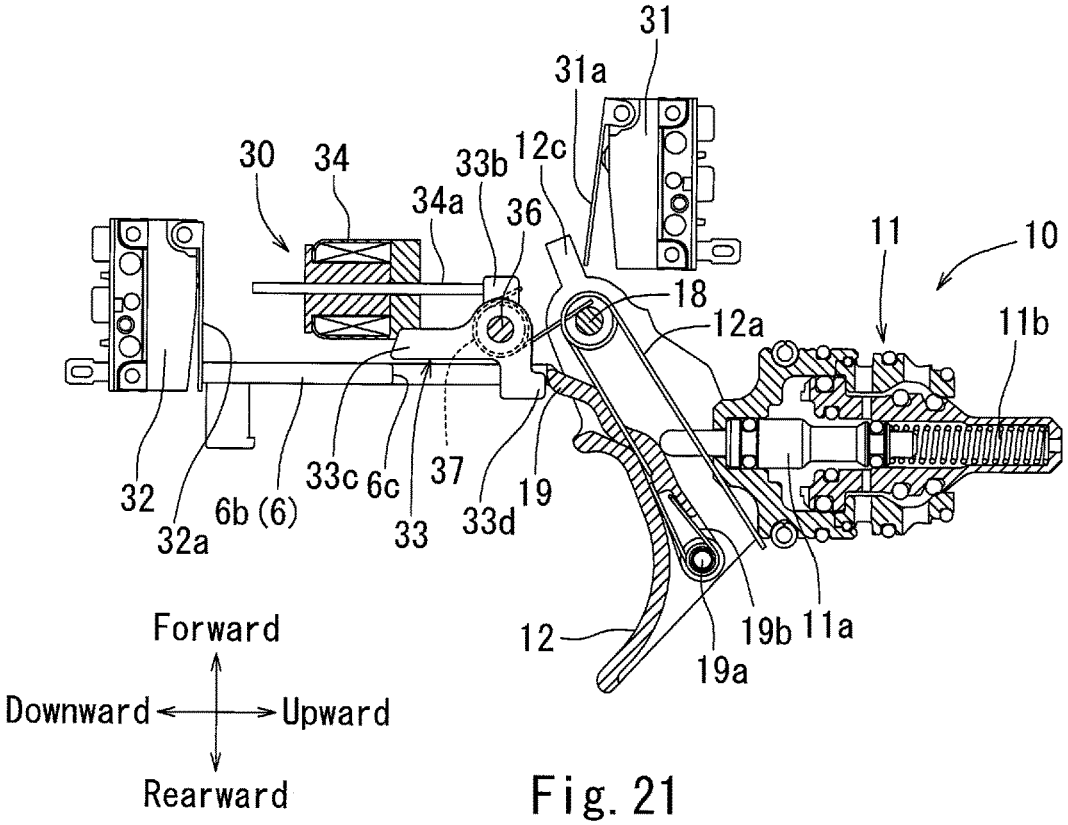
FIG. 21 is a longitudinal cross-sectional view of the starting device of the second embodiment in the state where the trigger has been activated from the initial state shown in FIG. 20, while the contact arm is deactivated.

When the trigger 12 in the initial state, as shown in FIG. 20, is activated, as shown in FIG. 21, the switch actuating portion 12*c* moves downward (away from the trigger switch 31) to turn on the trigger switch 31. When the trigger switch 31 is turned on, the controller 35 starts measuring the monitoring time. When the trigger 12 is activated, and thus the trigger switch 31 is turned on, the controller 35 supplies power to the actuator 34. The actuator 34 then moves the actuating shaft 34*a* upward to hold the contact arm stopper element 33 in the unlock position.

Figure 22:
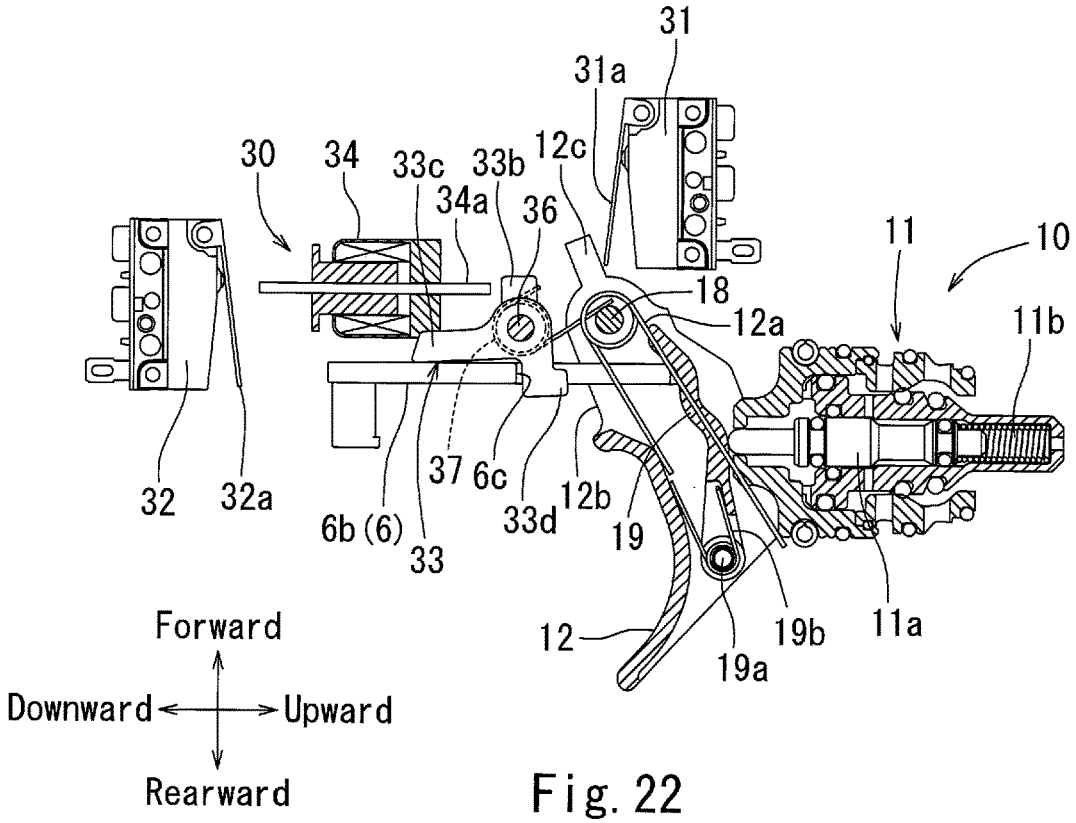
FIG. 22 is a longitudinal cross-sectional view of the starting device of the second embodiment in the state where the contact arm has been subsequently activated after the trigger was activated and within the reference time, and where the starting valve has been activated.

Before reaching the reference time t after the trigger 12 has been activated, the contact arm stopper element 33 is held in the unlock position, thereby allowing the contact arm 6 to be activated. As shown in FIG. 22, if the contact arm 6 is activated before the reference time t has been reached, the elongate portion 6*b* pushes the idler 19 upward to activate the starting valve 11. The activation of the starting valve 11 causes a driving action in the tool body 2.

Furthermore, when the contact arm 6 is activated, the elongate portion 6*b* integrally moves upward to return the actuating lever 32*a* of the contact arm switch 32 upward, thereby turning on the contact arm switch 32. When the contact arm switch 32 is turned on, the controller 35 stops measurement of the monitoring time and cuts off the power supply to the actuator 34, and the timer is reset. In this state, however, the contact arm stopper element 33 is not moved to the lock position that would block the movement of the contact arm 6 even though the trigger 12 is still being activated and the power supply to the actuator 34 is cut off, thus returning the actuating shaft 34*a* downward. Because the lock receiving portion 6*c* of the contact arm 6 has already passed by the rearward side of the lock arm 33*c*, the lock arm 33*c* rests on the forward surface of the elongate portion 6*b*.

Figure 23:
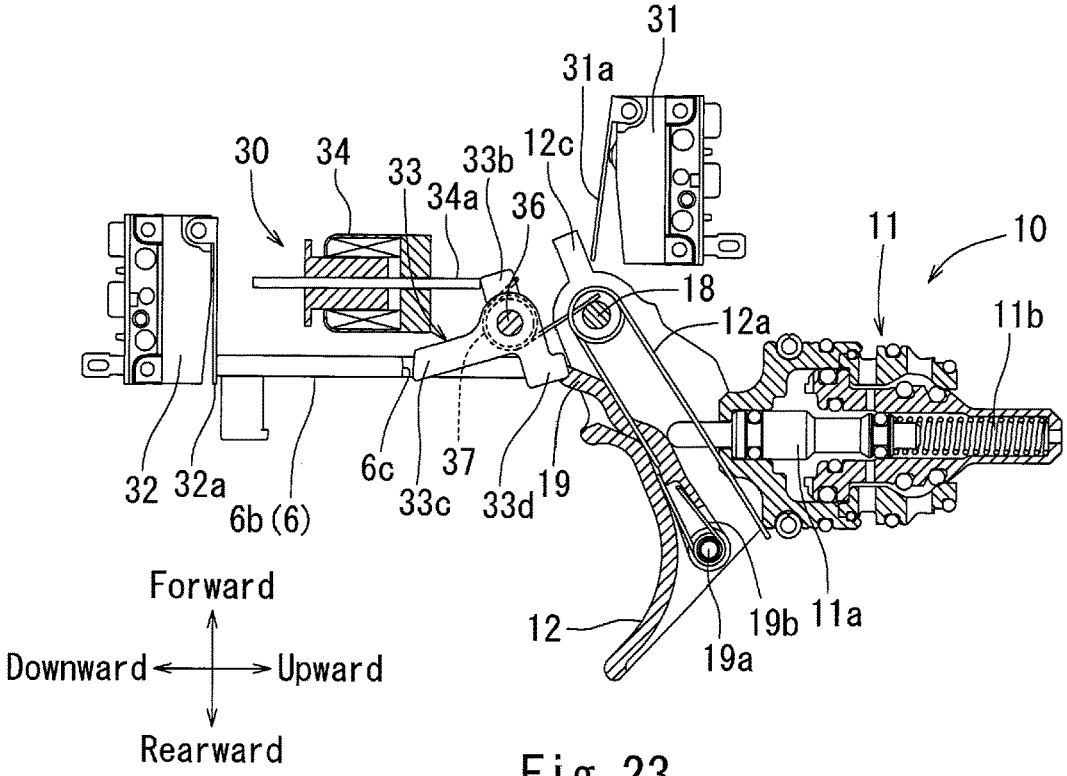
FIG. 23 is a longitudinal cross-sectional view of the starting device of the second embodiment in the state where activation of the contact arm is locked after the reference time has passed since the trigger was activated.

As shown in FIG. 23, if the contact arm 6 is not activated before reaching the reference time t after the trigger 12 has been activated, the controller 35 cuts off the power supply to the actuator 34 when the monitoring time reaches the reference time t. When the power supply to the actuator 34 is cut off, the actuating shaft 34*a* returns downward. As a result, the contact arm stopper element 33 rotates counterclockwise, as seen in the FIG. 23, to the lock position. When the contact arm stopper element 33 moves to the lock position, the lock arm 33*c* enters the upward side of the lock receiving portion 6*c*, thereby prohibiting activation of the contact arm 6. This prevents an inadvertent driving action from occurring when the driving tool 1 is carried with the trigger 12 being activated.

The prohibition of the activation of the contact arm 6 is removed by releasing the activated trigger 12. When the trigger 12 is released, the stopper receiving portion 12*b* pushes the stopper portion 33*d* downward. This returns the contact arm stopper element 33 to the unlock position, so that the contact arm 6 can be activated. When the trigger 12 is deactivated, the actuating lever 31*a* of the trigger switch 31 is pushed upward to turn off the trigger switch 31. Thus the starting device 10 is restored to the initial state, as shown in FIG. 20.

Figure 24:
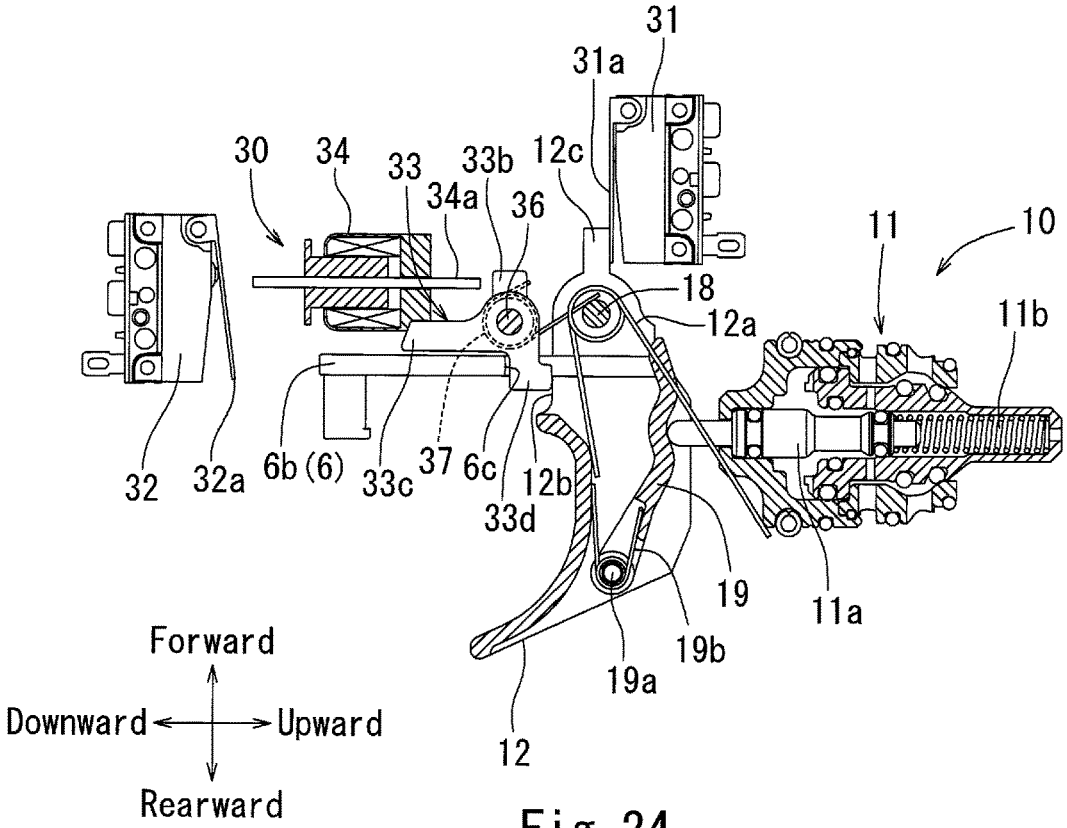
FIG. 24 is a longitudinal cross-sectional view of the starting device of the second embodiment in the state where the contact arm has been activated from the initial state shown in FIG. 20, while the trigger is deactivated.
Figure 25:
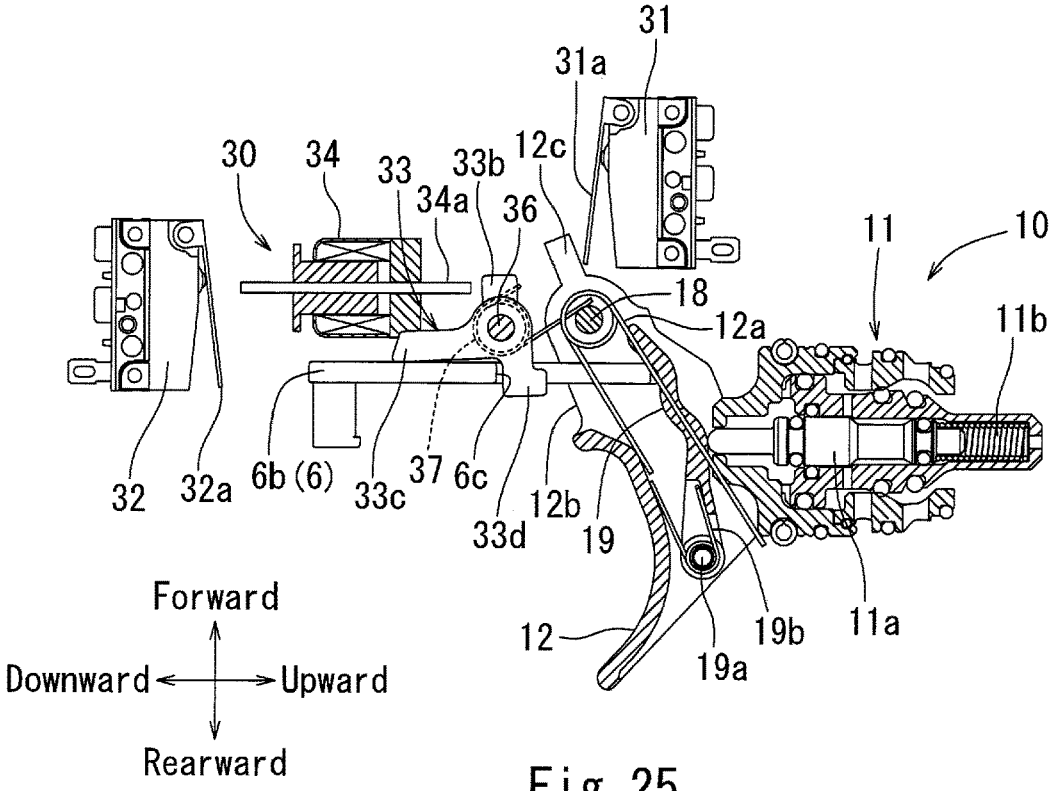
FIG. 25 is a longitudinal cross-sectional view of the starting device of the second embodiment in the state where the trigger has been subsequently activated from the state shown in FIG. 24 and where the starting valve is activated.

In the initial state of the starting device 10, the stopper receiving portion 12*b* of the trigger 12 holds the contact arm stopper element 33 in the unlock position. Accordingly, the contact arm 6 can be activated first. As shown in FIG. 24, when the contact arm 6 is activated by being pressed against the target workpiece W while the trigger 12 is deactivated, the contact arm switch 32 is turned on but the trigger switch 31 is not turned on. Accordingly, the controller 35 does not start measurement of the monitoring time. As shown in FIG. 25, when the trigger 12 is activated in the state where the idler 19 is pushed upward by the activation of the contact arm 6, the idler 19 pushes the stem 11*a* upward to turn on the starting valve 11. This results in a driving action being performed in the tool body 2. FIGS. 22 and 25 show, in effect, the same state of the starting device 10. FIG. 22 corresponds to the case where the trigger 12 is activated first and then the contact arm 6 is activated, while FIG. 25 corresponds to the case where the contact arm 6 is first activated and then the trigger 12 is activated. The timer operates in the controller 35 to measure the time only when the trigger switch 31 is turned on and the contact arm switch 32 is off.

Figure 26:
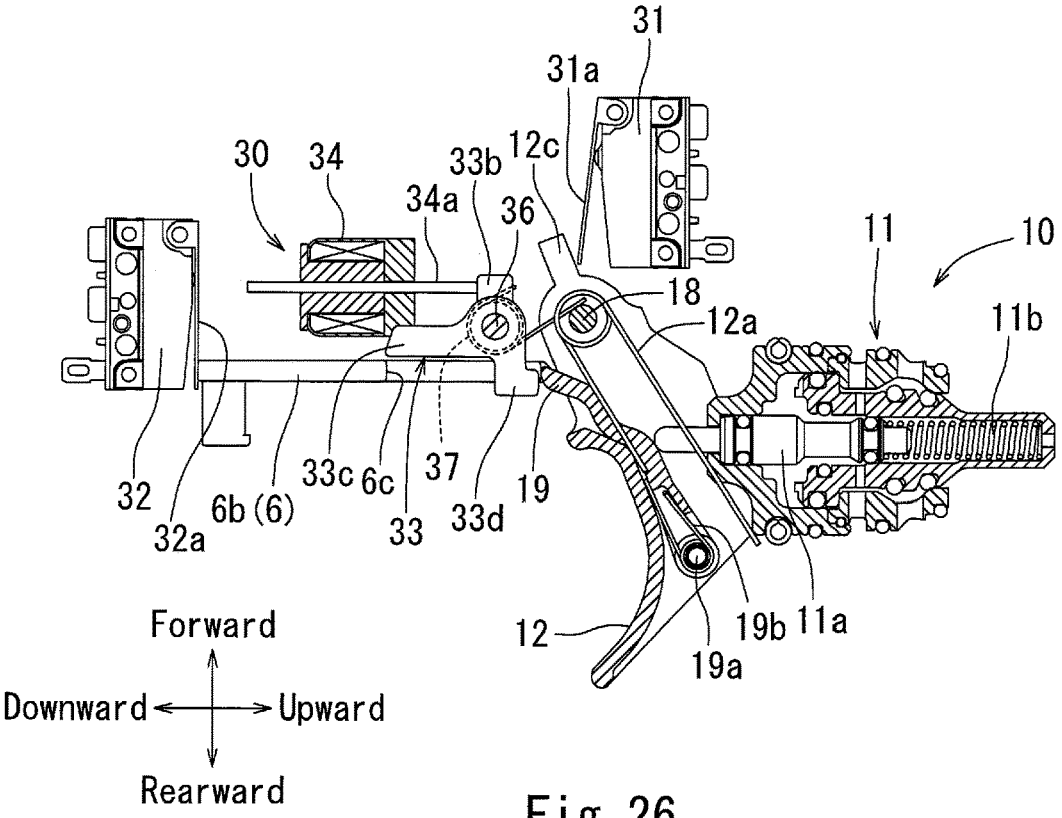
FIG. 26 is a longitudinal cross-sectional view of the starting device of the second embodiment in the state where the contact arm in the state shown in FIG. 25 has been returned to the deactivated position.

After the completion of a driving action, deactivation of the contact arm 6 may occur, as shown in FIG. 26, resulting in the state with the trigger switch 31 on and the contact arm switch 32 off, which is the same state as that in FIG. 21. In this state, the controller 35 supplies power to the actuator 34 to push the actuating shaft 34*a* upward, thereby holding the contact arm stopper element 33 in the unlock position. When the contact arm stopper element 33 is held in the unlock position, the contact arm 6 is allowed to be activated.

When the contact arm 6 is deactivated, and thus in the state where the trigger switch 31 is on and the contact arm switch 32 is off, the controller 35 starts measuring the time duration of that state. When the controller 35 starts measuring the time duration, the actuator 34 is supplied power. This causes the actuator shaft 34*a* to move the contact arm stopper element 33 from the locked position to the unlocked position. When the contact arm 6 is activated again before the time duration reaches the reference time t, the starting valve 11 is turned on to cause a driving action. When the contact arm 6 is activated again, the contact arm switch 32 is turned on and the time measurement in the controller 35 stops.

Figure 27:
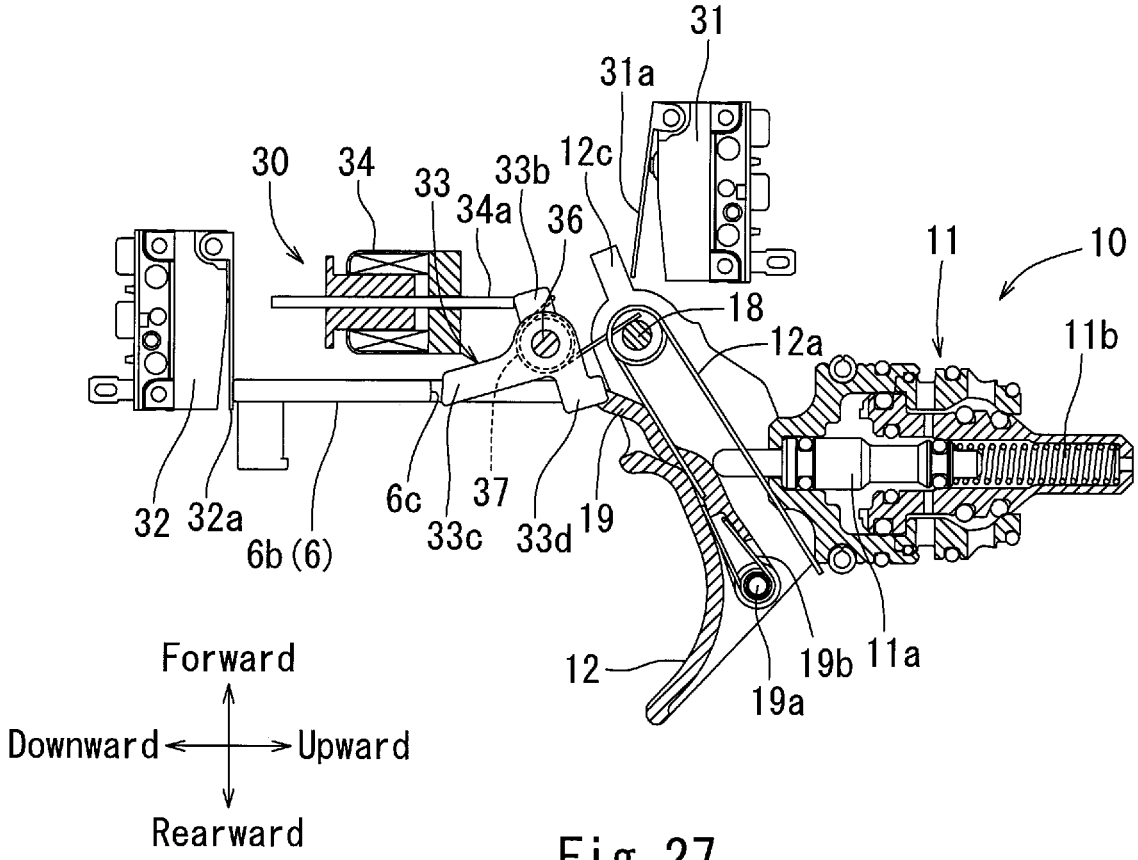
FIG. 27 is a longitudinal cross-sectional view of the starting device of the second embodiment in the state where activation of the contact arm is locked after the contact arm was returned to the deactivated position while the trigger was kept activated as shown in FIG. 25 and after the reference time has elapsed.

If the contact arm 6 is not activated before the reference time t has been reached, the power supply to the actuator 34 is cut off, as shown in FIG. 27. This causes the contact arm stopper element 33 to move to the lock position, thereby prohibiting activation of the contact arm 6. FIG. 27 corresponds to the state where activation of the contact arm 6 is prohibited, which is the same state as that in FIG. 23. As described above, the prohibition of the activation of the contact arm 6 is removed (i.e. reset to the initial state) by deactivating the trigger 12. Deactivating the trigger 12 returns the contact arm stopper element 33 to the unlock position against the biasing force of the torsion spring 37. Then the trigger switch 31 may be turned on again.

In the starting device 10 that includes the timer mechanism 30 of the second embodiment configured as described above, the timer mechanism 30 operates when the trigger 12 is activated and the contact arm 6 is not activated. Accordingly, after the reference time t has passed, an inadvertent driving action by an accidental contact of the contact arm 6 with some other object when, for example, the driving tool 1 is carried with the trigger 12 being activated is prevented.

Furthermore, the timer mechanism 30 of the second embodiment does not include any elements or devices that are powered by compressed air. Accordingly, the operation of each of its parts is more agile (and responsive), resulting in higher work efficiency when using the driving tool 1 (e.g. rapid-firing performance). Furthermore, as shown in FIGS. 24 and 25, when activating the contact arm 6 first, the driving action is performed without requiring a power supply to the actuator 34. Accordingly, the timer mechanism 30 of the second embodiment of the present invention allows the driving tool 1 to be used in a condition without power supply, and thus the driving work can be continued even in the event of a sudden power cutoff or a depleted power source.

Additionally, since the actuator 34 of the second embodiment may only powered when the contact arm 6 is deactivated and the trigger 12 is activated, the actuator 34 may be configured to be powered for a maximum length of time equaling the reference time t. For example, the actuator 34 may be unpowered during the time of each driving operation, which often requires the contact arm 6 to be activated. Accordingly, power savings may be realized. Additionally, the driving operation modes may be dynamically switched, with minimal effect to the safety performance of preventing inadvertent driving operations.

In some embodiments, the above described switches may electrically connected so as to selectively control the power being supplied to the controller. For instance, the timer switch 23 of the first embodiment may be electrically connected so as to only allow the controller 27 to be powered when the trigger 12 is activated and the contact arm 6 is deactivated. As another example, the contact arm switch 32 of the second embodiment may be a normally-open type switch, and the trigger switch 31 may be a normally-closed type switch. The contact arm switch 32 and the trigger switch 31 may be electrically connected so as to jointly control the flow of electricity to the controller 35. More specifically, switches may only allow the flow of power when the contact arm 6 is deactivated and the trigger 12 is activated, thereby allowing power to flow through each of the switches. By adjusting the way in which the switches are electrically connected to the controller, the circuitry may be simplified and further power savings can be realized, for example by reducing the power needed to determine the state of the switches.

In various embodiments, the number and location of the switches may be adjusted. As one example, the driving tool 1 may comprise only a single switch in a location different than that described with regards to the first embodiment. For instance, the single switch could be located upward of both the contact arm 6 and the trigger 12. This location of the single switch allows for both the contact arm 6 and the trigger 12 to contact the single switch. If the single switch is a normally-closed type switch, the controller could be configured to determine the elapsed time only when the single switch is not being activated (e.g., is in the closed state). For instance, both the contact arm and the trigger could be configured to directly contact the switch. Accordingly, the time determination could be configured to only be performed when the trigger 12 is activated and the contact arm 6 is deactivated. Based on this potential embodiment, the number of complexity of components may be reduced.

Further modifications are possible to the embodiments described above. For example, while a compressed-air powered nail gun has been described as an example of the driving tool 1, the present disclosure can be similarly applied to other driving tools, such as an electric tacker or other driving tools that have a contact arm that prevents accidental driving actions.

What is claimed is:

1. A driving tool, comprising:

a tool body;

a trigger;

a contact arm; and a timer mechanism configured to physically prevent activation of the contact arm, wherein the timer mechanism is further configured to:

be activated when the trigger is detected to be activated while the contact arm is detected to not be activated during a preset reference time that begins when the trigger is initially activated, and not be activated when the contact arm is detected to be activated within the preset reference time.

2. The driving tool of claim 1, wherein the timer mechanism comprises a timer switch configured to allow current to flow by activation of the trigger.

3. The driving tool of claim 2, wherein the timer switch is further configured to prevent the flow of current by activation of the contact arm within the preset reference time of the timer mechanism being activated.

4. The driving tool of claim 3, wherein the timer switch is further configured to allow the flow of current by a deactivation of the contact arm after activation of the contact arm.

5. The driving tool of claim 1, wherein:

the timer mechanism comprises a contact arm stopper element for preventing activation of the contact arm, and the contact arm stopper element is configured to be selectively placed in a lock position to prevent activation of the contact arm or an unlock position to allow activation of the contact arm, depending on how long the timer mechanism has been activated.

6. The driving tool of claim 5, further comprising an actuator, wherein the actuator is configured to prevent the contact arm stopper element from moving into a lock position within the preset reference time of the timer mechanism being activated.

7. The driving tool of claim 5, further comprising an actuator, wherein when the actuator is configured to allow the contact arm stopper element to be moved to the lock position after the preset reference time of the timer mechanism being activated.

8. The driving tool of claim 5, wherein when the trigger is deactivated:

the timer mechanism is deactivated, and the contact arm stopper element is returned to an unlock position.

9. The driving tool of claim 1, wherein the timer mechanism is configured to not be activated when the trigger are detected to be activated while the contact arm is activated.

10. The driving tool of claim 1, wherein the trigger and/or the contact arm is determined to be activated when a controller is powered by a power supply.

11. The driving tool of claim 1, wherein:

the contact arm includes a release guide; and the release guide is configured to cause the timer mechanism to be deactivated when the contact arm is detected to be activated within the preset reference time.

12. The driving tool of claim 11, wherein the release guide is configured to cause an actuation arm provided in the timer mechanism to be displaced to a position in which a flow of current is prevented.

13. The driving tool of claim 1, wherein the trigger is configured to physically contact the contact arm stopper element so as to move it to an unlock position upon deactivation of the trigger.

14. A driving tool, comprising:

a tool body;

a trigger;

a contact arm; and a timer mechanism configured to be started only when the trigger is activated and the contact arm is not activated, wherein the timer mechanism comprises:

a trigger switch configured to detect activation of the trigger;

a contact arm switch configured to detect activation of the contact arm; and a contact arm stopper element configured to be moved to a lock position to prevent activation of the contact arm if a preset reference time has been reached since the timer mechanism was started.

15. The driving tool of claim 14, wherein the contact arm stopper element is configured to not be moved to the lock position when the contact arm is activated within the preset reference time of the timer mechanism being activated.

16. The driving tool of claim 14, wherein the trigger is configured to physically contact the contact arm stopper so as to move it to an unlock position upon deactivation of the trigger.

17. The driving tool of claim 14, wherein the contact arm stopper element is moved to the lock position by a biasing force of a torsion spring.

18. A driving tool, comprising:

a trigger;

a contact arm;

an actuator; and a contact arm stopper element biased by a biasing force to be moved to a lock position for preventing activation of the contact arm, wherein:

the actuator applies a blocking force sufficient to overcome the biasing force to the contact arm stopper element within a preset reference time of the trigger being activated; and the actuator is configured to remove the blocking force applied to the contact arm stopper element after the preset reference time has been reached.

19. The driving tool of claim 18, wherein the actuator does not supply the blocking force to the contact arm stopper element while the contact arm is activated.

20. The driving tool of claim 18, wherein the trigger is configured to physically contact the contact arm stopper element so as to move it to an unlock position upon deactivation of the trigger.

21. The driving tool of claim 20, wherein the trigger physically moves the contact arm stopper element regardless of the preset reference time.

22. The driving tool of claim 18, wherein the contact arm stopper element is moved to the lock position by the biasing force of a torsion spring.

23. A driving tool, comprising:

a tool body;

a trigger;

a contact arm; and a timer mechanism configured to physically prevent activation of the contact arm, wherein:

the timer mechanism includes a timer and a stopper element;

the timer begins a time count when the trigger is activated and the contact arm is not activated; and the timer mechanism is configured such that:

the stopper element prevents activation of the driving tool to drive a workpiece when the trigger is activated and the contact arm is not activated during a preset reference time that begins when the trigger is initially activated;

the stopper element does not prevent activation of the driving tool to drive the workpiece when the trigger is activated and the control arm is activated within the preset reference time of the time count; and the stopper element prevents activation of the driving tool to drive the workpiece when the trigger is activated and the contact arm is initially activated after the preset reference time.

* * * * *